US009772574B2

(12) United States Patent
Kobayashi et al.

(10) Patent No.: US 9,772,574 B2
(45) Date of Patent: Sep. 26, 2017

(54) TONER

(71) Applicant: KYOCERA Document Solutions Inc., Osaka (JP)

(72) Inventors: Ryota Kobayashi, Osaka (JP); Masami Tsujihiro, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 224 days.

(21) Appl. No.: 14/571,430

(22) Filed: Dec. 16, 2014

(65) Prior Publication Data

US 2015/0177633 A1 Jun. 25, 2015

(30) Foreign Application Priority Data

Dec. 20, 2013 (JP) ..... 2013-263828

(51) Int. Cl.
*G03G 9/093* (2006.01)
*G03G 9/097* (2006.01)

(52) U.S. Cl.
CPC ..... *G03G 9/09328* (2013.01); *G03G 9/09385* (2013.01); *G03G 9/09392* (2013.01); *G03G 9/09725* (2013.01)

(58) Field of Classification Search
CPC ..... G03G 9/09328; G03G 9/09342; G03G 9/09385; G03G 9/09392
See application file for complete search history.

(56) References Cited

U.S. PATENT DOCUMENTS 4,740,443 A * 4/1988 Nakahara ..... G03G 9/0825 430/108.24
7,405,000 B2 7/2008 Takikawa et al.
9,377,709 B2 * 6/2016 Nozaki ..... G03G 9/09307
2005/0271964 A1 12/2005 Etou et al.
(Continued)

FOREIGN PATENT DOCUMENTS

JP S58-145965 A 8/1983
JP S62-253176 A 11/1987
(Continued)

OTHER PUBLICATIONS

An Office Action; "Notice of Reasons for Rejection," issued by the Japanese Patent Office on Mar. 15, 2016, which corresponds to Japanese Patent Application No. 2013-263828 and is related to U.S. Appl. No. 14/571,430.

*Primary Examiner* — Janis L Dote
(74) *Attorney, Agent, or Firm* — Studebaker & Brackett PC

(57) ABSTRACT

A toner includes toner particles. The toner particles each include a toner core, silica particles located on a surface of the toner core, and a shell layer disposed over the surface of the toner core on which the silica particles are located. For at least 80% by number of the toner particles, along at least 80% of a circumferential length of a cross-section of the toner particle when the cross-section is analyzed by EELS, the shell layer has a thickness of at least 5 nm and satisfies a condition that a ratio of an intensity INc relative to an intensity INs is at least 0.0 and no greater than 0.2. The intensity INs indicates intensity of an N—K shell absorption-edge originating from nitrogen atoms in the shell layer. The intensity INc indicates intensity of an N—K shell absorption-edge originating from nitrogen atoms in the toner core.

10 Claims, 8 Drawing Sheets

(56) References Cited

U.S. PATENT DOCUMENTS

| | | | | |
|---|---|---|---|---|
| 2006/0165989 | A1 | 7/2006 | Takikawa et al. | |
| 2015/0118612 | A1* | 4/2015 | Maetani ..... | G03G 9/09328<br>430/109.1 |

FOREIGN PATENT DOCUMENTS

| | | | |
|---|---|---|---|
| JP | H03-005762 | A | 1/1991 |
| JP | 2004-294469 | A | 10/2004 |
| JP | 2006-276069 | A | 10/2006 |
| JP | 2010-079318 | A | 4/2010 |

* cited by examiner

TONER

INCORPORATION BY REFERENCE

The present application claims priority under 35 U.S.C. §119 to Japanese Patent Application No. 2013-263828, filed Dec. 20, 2013. The contents of this application are incorporated herein by reference in their entirety.

BACKGROUND

The present disclosure relates to a toner.

A toner (electrostatic latent image developing toner) is used in an electrophotographic image forming apparatus. The image forming apparatus fixes the toner to a recording medium such as paper through application of heat and pressure to the toner. Typically the toner contains a binder resin having a low softening point Tm and a low glass transition point Tg, and a releasing agent having a low softening point Tm in order to ensure energy efficiency during fixing and enable device miniaturization. As a consequence, storage of the toner at high temperatures may cause aggregation of toner particles included in the toner. Aggregated toner particles tend to have a lower charge than non-aggregated toner particles. Therefore, an image defect may occur when aggregated toner particles are fixed to a recording medium.

A known capsule toner includes a plurality of toner particles that each include a toner core and a shell layer (capsule layer) disposed over the surface of the toner core. The capsule toner can be fixed at relatively low temperatures and, as a consequence, power consumption can be reduced and occurrence of image defects can be inhibited through use of the capsule toner.

SUMMARY

A toner according to the present disclosure includes toner particles. Each of the toner particles includes a toner core, silica particles located on a surface of the toner core, and a shell layer disposed over the surface of the toner core on which the silica particles are located. For at least 80% by number of the toner particles, along at least 80% of a circumferential length of a cross-section of the toner particle when the cross-section is analyzed by electron energy loss spectroscopy (EELS), the shell layer has a thickness of at least 5 nm and satisfies a condition that a ratio of an intensity INc relative to an intensity INs is at least 0.0 and no greater than 0.2. The intensity INs indicates intensity of an N—K shell absorption-edge originating from nitrogen atoms in the shell layer. The intensity INc indicates intensity of an N—K shell absorption-edge originating from nitrogen atoms in the toner core.

DETAILED DESCRIPTION

The following explains a toner according to an embodiment of the present disclosure with reference to the drawings. However, the present disclosure is of course not limited to the embodiment.

The toner (electrostatic latent image developing toner) according to the present embodiment includes a plurality of toner particles. The toner according to the present embodiment is for example used in an image forming apparatus such as an electrophotographic apparatus. In the electrophotographic apparatus, the toner according to the present embodiment, or a developer including a carrier and the toner according to the present embodiment, is caused to attach to an electrostatic latent image formed on a photosensitive member while in a charged state. Through the above, an electrostatic charge image is developed. After development, toner attached to the photosensitive member is transferred onto a transfer belt and is subsequently transferred from the transfer belt onto a recording medium (for example, paper). The toner is fixed to the recording medium through heating. The process described above results in formation of an image on the recording medium. A full-color image can for example be obtained by superposing toner images formed using four different colors: black, yellow, magenta, and cyan.

Figure 1:
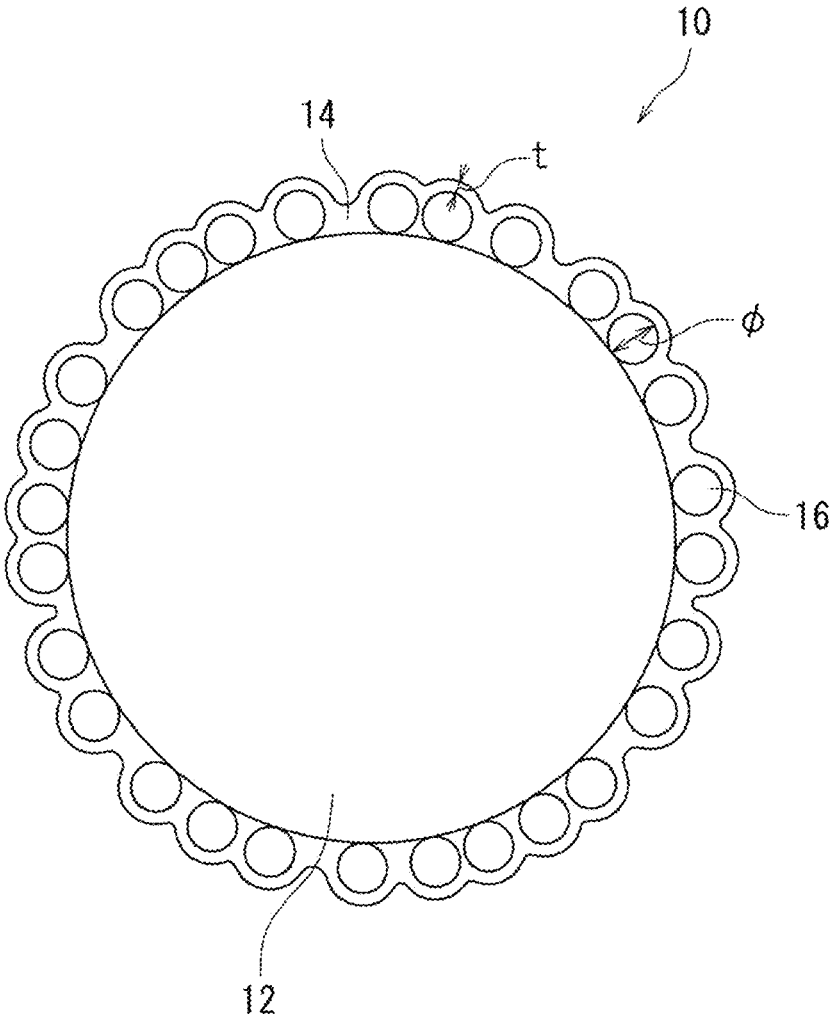
FIG. 1 illustrates a toner particle included in a toner according to an embodiment of the present disclosure.

The following explains a toner particle 10 with reference to FIG. 1. The toner particle 10 includes a toner core 12, silica particles 16, and a shell layer 14. The toner core 12 contains a so-called toner component. The silica particles 16 are located on the surface of the toner core 12. The shell layer 14 covers (is disposed such as to cover) the surface of the toner core 12 on which the silica particles 16 are located.

Formation of the shell layer 14 covering the toner core 12 leads to the toner particle 10 having excellent properties in terms of, for example, blocking resistance, transportability, and preservability. Once a toner image formed by toner particles 10 has been transferred onto a recording medium such as paper, the shell layer 14 of each of the toner particles 10 is ruptured through application of heat and load on the toner image. Upon rupturing of the shell layer 14, the toner core 12 is released from the shell layer 14 and is subsequently fixed by melting or softening of the toner core 12 on the recording medium.

Even when the shell layer 14 covering the toner core 12 of the toner particle 10 has a high hardness, the shell layer 14 can be readily ruptured due to the silica particles 16 acting as starting points for rupturing of the shell layer 14.

As a result, the temperature and load used during fixing on the recording medium can be sufficiently reduced while still enabling good fixing to the recording medium of the toner component contained in the toner core 12.

Thus, the presence of the silica particles 16 between the toner core 12 and the shell layer 14 of the toner particle 10 enables the shell layer 14 to be more readily ruptured under high temperature and high pressure conditions. In particular, the shell layer 14 can be more readily ruptured in a configuration in which a particle size 0 of the silica particles 16 is greater than a thickness t of the shell layer 14 as shown in FIG. 1.

The following explains the toner core 12. The toner core 12 can contain a binder resin. The toner core 12 is preferably anionic. The binder resin for example preferably has an ester group, a hydroxyl group, a carboxyl group, an ether group, an acid group, or a methyl group as a functional group. More preferably, molecules of the binder resin include either or both of a hydroxyl group and a carboxyl group. Reasoning behind the above is that such functional groups can react to form a chemical bond with a monomer-derived unit (for example, methylol melamine) of a thermosetting resin that is contained in the shell layer 14. As a result, the toner core 12 and the shell layer 14 included in the toner particle 10 are strongly bound to each another.

When the binder resin includes a carboxyl group, the binder resin preferably has an acid value of at least 3 mg KOH/g and no greater than 50 mg KOH/g, and more preferably at least 10 mg KOH/g and no greater than 40 mg KOH/g, in order that the toner core 12 is sufficiently anionic. When the binder resin includes a hydroxyl group, the binder resin preferably has a hydroxyl value of at least 10 mg KOH/g and no greater than 70 mg KOH/g, and more preferably at least 15 mg KOH/g and no greater than 50 mg KOH/g, in order that the toner core 12 is sufficiently anionic.

Specific examples of the binder resin include thermoplastic resins such as styrene-based resins, acrylic-based resins, styrene-acrylic-based resins, polyethylene-based resins, polypropylene-based resins, vinyl chloride-based resins, polyester resins, polyamide-based resins, polyurethane-based resins, polyvinyl alcohol-based resins, vinyl ether-based resins, N-vinyl-based resins, and styrene-butadiene-based resins. Among the resins listed above, styrene-acrylic-based resins and polyester resins are preferable in terms of improving colorant dispersibility in the toner, chargeability of the toner, and fixability of the toner to the recording medium.

The styrene-acrylic-based resin is a copolymer of a styrene-based monomer and an acrylic-based monomer. Specific examples of the styrene-based monomer include styrene, α-methylstyrene, p-hydroxystyrene, m-hydroxystyrene, vinyltoluene, α-chlorostyrene, o-chlorostyrene, m-chlorostyrene, p-chlorostyrene, and p-ethylstyrene.

Specific examples of the acrylic-based monomer include (meth)acrylic acid, alkyl (meth)acrylates, and hydroxyalkyl (meth)acrylates. Examples of the alkyl (meth)acrylate include methyl (meth)acrylate, ethyl (meth)acrylate, n-propyl (meth)acrylate, iso-propyl (meth)acrylate, n-butyl (meth)acrylate, iso-butyl (meth)acrylate, and 2-ethylhexyl (meth)acrylate. Examples of the hydroxyalkyl (meth)acrylate include 2-hydroxyethyl (meth)acrylate, 3-hydroxypropyl (meth)acrylate, 2-hydroxypropyl (meth)acrylate, and 4-hydroxybutyl (meth)acrylate.

Note that the term "(meth)acrylic" is used herein as a generic term for both acrylic and methacrylic.

A hydroxyl group can be introduced into the styrene-acrylic-based resin by using a monomer having a hydroxyl group (for example, p-hydroxystyrene, m-hydroxystyrene, or a hydroxyalkyl (meth)acrylate) during preparation of the styrene-acrylic-based resin. The hydroxyl value of the styrene-acrylic-based resin can be adjusted through appropriate adjustment of the amount of the monomer having the hydroxyl group.

A carboxyl group can be introduced into the styrene-acrylic-based resin by using (meth)acrylic acid as a monomer during preparation of the styrene-acrylic-based resin. The acid value of the styrene-acrylic-based resin can be adjusted through appropriate adjustment of the amount of the (meth)acrylic acid.

The polyester resin is acquired through condensation polymerization or condensation copolymerization of a di-, tri-, or higher-hydric alcohol component and a di-, tri-, or higher-basic carboxylic acid component.

Examples of the dihydric alcohol component include diols and bisphenols. Specific examples of diols include ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol. Specific examples of bisphenols include bisphenol A, hydrogenated bisphenol A, polyoxyethylenated bisphenol A, and polyoxypropylenated bisphenol A.

Examples of the tri- or higher-hydric alcohol component include tri- or higher-hydric alcohols. Specific examples of tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of the dibasic carboxylic acid component include dibasic carboxylic acids. Specific examples of dibasic carboxylic acids include maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, alkyl succinic acids (for example, n-butyl succinic acid, isobutylsuccinic acid, n-octylsuccinic acid, n-dodecylsuccinic acid, and isododecylsuccinic acid), and alkenyl succinic acids (for example, n-butenyl succinic acid, isobutenylsuccinic acid, n-octenylsuccinic acid, n-dodecenylsuccinic acid, and isododecenylsuccinic acid).

Examples of the tri- or higher-basic carboxylic acid component include tri- or higher-basic carboxylic acids. Specific examples of tri- or higher-basic carboxylic acids include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, and EMPOL trimer acid.

Alternatively, an ester-forming derivative (for example, an acid halide, an acid anhydride, or a lower alkyl ester) of any of the above listed carboxylic acid components may be used. Herein the term "lower alkyl" refers to an alkyl group having 1 to 6 carbon atoms.

The acid value and the hydroxyl value of the polyester resin can be adjusted through appropriate adjustment the amount of the di-, tri-, or higher-hydric alcohol component and the amount of the di-, tri-, or higher-basic carboxylic acid component used in preparation of the polyester resin. Note that increasing the molecular weight of the polyester resin tends to decrease the acid value and the hydroxyl value of the polyester resin.

When the binder resin is a polyester resin, the polyester resin preferably has a number average molecular weight Mn of at least 1,200 and no greater than 2,000 in order to improve strength of the toner cores 12 and fixability of the toner particles 10. For the same reasons as given above, the polyester resin preferably has a molecular weight distribution (i.e., a ratio Mw/Mn of the mass average molecular weight Mw relative to the number average molecular weight Mn) of at least 9 and no greater than 20.

When the binder resin is a styrene-acrylic-based resin, the styrene-acrylic-based resin preferably has a number average molecular weight Mn of at least 2,000 and no greater than 3,000 in order to improve strength of the toner cores 12 and fixability of the toner particles 10. For the same reasons as given above, the styrene-acrylic-based resin preferably has a molecular weight distribution (mass average molecular weight Mw/number average molecular weight Mn) of at least 10 and no greater than 20. The number average molecular weight Mn and the mass average molecular weight Mw of the binder resin can be measured by gel permeation chromatography.

In order to improve low-temperature fixability of the toner, the binder resin preferably has a glass transition point Tg that is no greater than a curing initiation temperature of the thermosetting resin contained in the shell layer 14. The glass transition point Tg of the binder resin being no greater than the curing initiation temperature of the thermosetting resin ensures sufficient fixability of the toner during high speed fixing. More specifically, the binder resin preferably has a glass transition point Tg of at least 20° C., more preferably at least 30° C. and no greater than 55° C., and particularly preferably at least 30° C. and no greater than 50° C. The glass transition point Tg of the binder resin being at least 20° C. can inhibit aggregation of the toner cores 12 during formation of the shell layers 14. Note that the thermosetting resin typically has a curing initiation temperature of approximately 55° C.

The glass transition point Tg of the binder resin can be measured by using a differential scanning calorimeter (DSC) to find a point of change in specific heat of the binder resin. More specifically, the glass transition point Tg of the binder resin can be measured by plotting a heat absorption curve of the binder resin using a DSC (for example, a DSC-6200 produced by Seiko Instruments Inc.) as a measuring device. In a specific example of a method of measuring the glass transition point Tg of the binder resin, 10 mg of a measurement sample of the binder resin is first placed in an aluminum pan. Next, using an empty aluminum pan as a reference, a heat absorption curve of the binder resin is plotted for a heating rate of 10° C./minute in a measurement temperature range from at least 25° C. to no greater than 200° C., and the glass transition point Tg of the binder resin is calculated based on the heat absorption curve.

The binder resin preferably has a softening point Tm of no greater than 100° C., and more preferably no greater than 95° C. The softening point Tm being no greater than 100° C. enables sufficient fixability of the toner, even during high speed fixing. The softening point Tm of the binder resin can for example be adjusted by combining, as the binder resin, a plurality of binder resins that each have a different softening point Tm.

The softening point Tm of the binder resin can be measured by a capillary rheometer (for example, a CFT-500D produced by Shimadzu Corporation). More specifically, a measurement sample is placed in the capillary rheometer and an S-shaped curve (i.e., an S-shaped curve of stroke (mm)/temperature (° C.)) is plotted by causing melt flow of 1 $cm^3$ of the sample under specified conditions (die pore diameter 1 mm, plunger load 20 $kg/cm^2$, heating rate 6° C./minute). The softening point Tm of the binder resin is read from the S-shaped curve that is plotted.

Figure 2:
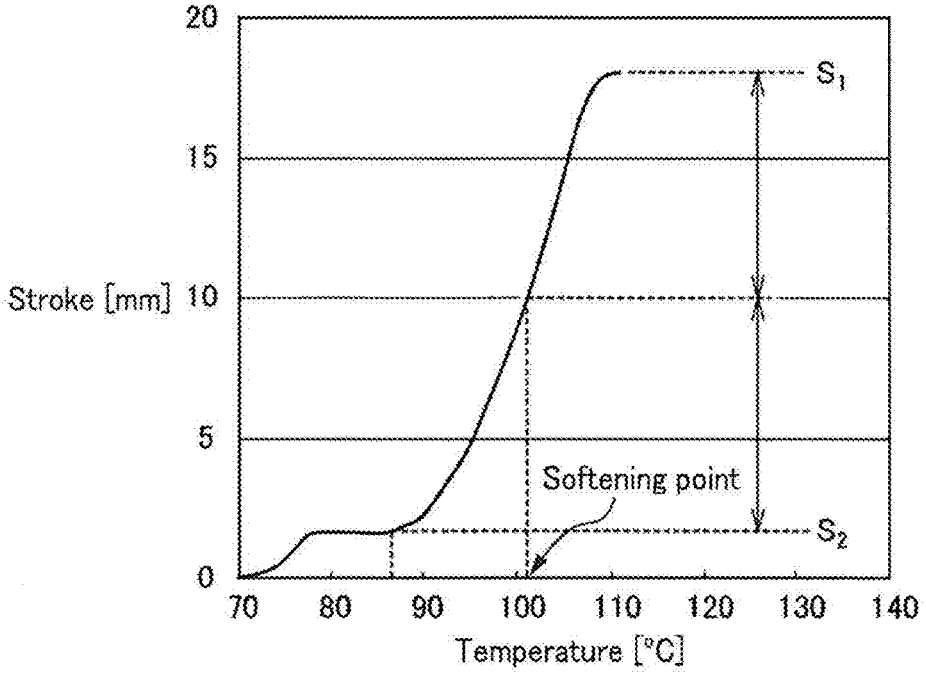
FIG. 2 is a graph illustrating a method of reading a softening point from an S-shaped curve.

The method of reading the softening point Tm of the binder resin is explained with reference to FIG. 2. In FIG. 2, $S_1$ represents a maximum stroke value and $S_2$ represents a baseline stroke value at lower temperatures than temperatures for which the stroke value is $S_1$. The softening point Tm of the measurement sample (binder resin) is taken to be a temperature corresponding to a stroke value along the S-shaped curve of $(S_1+S_2)/2$.

The following returns to explanation of the toner particle 10 with reference to FIG. 1. The toner core 12 may optionally contain a commonly known pigment, dye, or both of the above as a colorant in accordance with a desired color of the toner particle 10. The colorant may be a black colorant such as carbon black. Alternatively, the colorant may be a black colorant that has been adjusted to a black color using non-black colorants such as a yellow colorant, a magenta colorant, and a cyan colorant described below.

In a situation in which the toner is a color toner, the colorant contained in the toner core 12 may be a non-black colorant such as a yellow colorant, a magenta colorant, or a cyan colorant.

Examples of the yellow colorant include condensed azo compounds, isoindolinone compounds, anthraquinone compounds, azo metal complexes, methine compounds, and arylamide compounds. Specific examples of the yellow colorant include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C.I. Vat Yellow.

Examples of the magenta colorant include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples of the magenta colorant include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

Examples of the cyan colorant include copper phthalocyanine compounds, copper phthalocyanine derivatives, anthraquinone compounds, and basic dye lake compounds. Specific examples of the cyan colorant include C.I. Pigment Blue (1, 7, 15, 15:1, 15:2, 15:3, 15:4, 60, 62, and 66), Phthalocyanine Blue, C.I. Vat Blue, and C.I. Acid Blue.

The amount of the colorant contained in the toner core 12 is preferably at least 1 part by mass and no greater than 10 parts by mass relative to 100 parts by mass of the binder resin, and more preferably at least 3 parts by mass and no greater than 7 parts by mass.

The toner core 12 may optionally contain a releasing agent in order to improve fixability of the toner, and also to inhibit offset and image smearing (i.e., staining around an image due to rubbing of the image). Examples of the releasing agent include, aliphatic hydrocarbon-based waxes (for example, low molecular weight polyethylene, low molecular weight polypropylene, polyolefin copolymer, polyolefin wax, microcrystalline wax, paraffin wax, and Fischer-Tropsch wax), oxides of aliphatic hydrocarbon-based waxes (for example, polyethylene oxide wax and block copolymer of polyethylene oxide wax), plant waxes (for example, candelilla wax, carnauba wax, Japan wax, jojoba wax, and rice wax), animal waxes (for example, beeswax, lanolin, and spermaceti), mineral waxes (for example, ozokerite, ceresin, and petrolatum), waxes having a fatty acid ester as a main component (for example, montanic acid ester wax and castor wax), and waxes containing partially or fully deoxidized fatty acid esters (for example, deoxidized carnauba wax).

In a configuration in which the toner core 12 contains a releasing agent, the amount of the releasing agent is preferably at least 1 part by mass and no greater than 5 parts by mass relative to 100 parts by mass of the binder resin.

The toner core 12 may optionally contain a charge control agent (CCA) in accordance with necessity thereof. As a result of the toner core 12 containing the charge control agent, charging level and a charge rise characteristic of the toner and can be improved, and also durability and stability of the toner can be improved. The charge rise characteristic of the toner is an indicator of whether or not the toner can be charged to a specific level of charge in a short period of time. In a configuration in which the toner core 12 is anionic (negatively chargable), a negatively chargeable charge control agent is preferably used.

The toner core 12 may optionally contain a magnetic powder in accordance with necessity thereof. In a configuration in which toner cores 12 contain a magnetic powder, the toner particles 10 are used as a magnetic one-component developer. Examples of preferable magnetic powders include iron (ferrite and magnetite), ferromagnetic metals (cobalt and nickel), alloys of either or both of iron and a ferromagnetic metal, compounds containing either or both of iron and a ferromagnetic metal, ferromagnetic alloys subjected to ferromagnetization such as heat treatment, and chromium dioxide.

The magnetic powder preferably has a particle size of at least 0.1 μm and no greater than 1.0 μm, and more preferably at least 0.1 μm and no greater than 0.5 μm. When the particle size of the magnetic powder is at least 0.1 μm and no greater than 1.0 μm, uniform dispersion of the magnetic powder throughout the binder resin can be easily achieved.

When the toner particles 10 are used as a one-component developer, the amount of the magnetic powder is preferably at least 35 parts by mass and no greater than 60 parts by mass relative to 100 parts by mass of the toner particles 10 overall, and more preferably at least 40 parts by mass and no greater than 60 parts by mass.

The following explains the shell layer 14. The shell layer 14 preferably contains a thermosetting resin. The shell layer 14 preferably has sufficient strength, hardness, and cationic strength. The thermosetting resin for example includes a unit in which a methylene group (—$CH_2$—) derived from formaldehyde has been introduced into a monomer such as melamine.

Examples of the thermosetting resin include melamine resins, urea resins (for example, urea-resorcin based resins), guanamine resins, urethane resin, amide resins, olefin resins, and gelatin-gum arabic resins. Among the thermosetting resins listed above, urea resins and in particular melamine resins are preferable in terms that it is not necessary to increase the fixing temperature to a high temperature.

A melamine resin is a polycondensate of melamine and formaldehyde, and thus the melamine resin is formed using melamine as a monomer. A urea resin is a polycondensate of urea and formaldehyde, and thus the urea resin is formed using urea as a monomer. Note that the melamine and the urea may alternatively be modified in a commonly known way.

The shell layer 14 may optionally contain a resin other than a thermosetting resin in accordance with necessity thereof, so long as the effects of the present embodiment are still achieved. The amount of the thermosetting resin contained in the shell layer 14 is preferably at least 90% by mass and no greater than 100% by mass relative to the overall mass of the shell layer 14, and more preferably is at least 95% by mass and no greater than 100% by mass. The amount of the thermosetting resin being at least 90% by mass ensures sufficient hardness of the shell layer 14.

Note that a substance that contains nitrogen atom can be readily charged to a desired positive charge; therefore, the shell layer 14 preferably contains nitrogen atoms derived, for example, from melamine or urea. In order to ensure sufficient positive charge of the shell layer 14, preferably the shell layer 14 contains at least 10% by mass of nitrogen atoms. The shell layer 14 may optionally contain a charge control agent. For example, the shell layer 14 may contain a positively chargeable charge control agent in order that the shell layer 14 is cationic (positively charged).

The thickness t of the shell layer 14 is preferably smaller than the particle size 0 of the silica particles 16. The thickness t of the shell layer 14 is preferably at least 5 nm, and more preferably at least 5 nm and no greater than 80 nm. The thickness t of the shell layer 14 can for example be measured by using commercially available image analysis software (for example, WinROOF produced by Mitani Corporation) to analyze a cross-sectional image of the toner particle 10 captured by a transmission electron microscope.

The silica particles 16 are covered by the shell layer 14. The silica particles 16 are harder than the shell layer 14. In terms of the difference between respective hardnesses of the shell layer 14 and the silica particles 16, the difference is for example at least one level, and preferably at least two levels, for hardnesses measured according to Japanese Industrial Standard JIS K5600 (pencil hardness measurement).

The particle size $\phi$ of the silica particles 16 when measured for primary particle size is preferably at least 10 nm and no greater than 100 nm, and more preferably at least 10 nm and no greater than 50 nm. The particle size (primary particle size) of the silica particles 16 being at least 10 nm ensures that the shell layer 14 can be readily ruptured and enables sufficient reduction in the temperature and load used during fixing. On the other hand, the particle size (primary particle size) of the silica particles 16 being no greater than 100 nm can inhibit occurrence of overcharging of the toner particle 10 and reduced density during image formation.

The silica particles 16 preferably have a specific surface area of at least 45 $m^2/g$ and no greater than 350 $m^2/g$, and more preferably at least 75 $m^2/g$ and no greater than 300 $m^2/g$. If the specific surface area of the silica particles 16 is excessively large or small, the silica particles 16 may become dissociated from the toner core 12. In contrast, the specific surface area of the silica particles 16 being at least 45 $m^2/g$ and no greater than 350 $m^2/g$ can inhibit dissociation of the silica particles 16 from the toner core 12.

The additive amount of the silica particles 16 is preferably at least 0.3% by mass and no greater than 7.0% by mass relative to the total mass of the toner particle 10, and more preferably is at least 0.5% by mass and no greater than 5.0% by mass. The additive amount of the silica particles 16 being at least 0.3% by mass relative to the total mass of the toner particle 10 enables the shell layer 14 to be readily ruptured, and thus enables sufficient lowering of the temperature and load used during fixing. On the other hand, the additive amount of the silica particles 16 being no greater than 7.0% by mass relative to the total mass of the toner particle 10 can inhibit occurrence of excessive charging of the toner particle 10 and reduction of image density to below a desired value during image formation. If the additive amount of the silica particles 16 is excessively large or small, the silica particles 16 may become dissociated from the toner core 12. In contrast, dissociation of the silica particles 16 from the toner core 12 can be inhibited through the additive amount of the silica particles 16 being at least 0.3% by mass and no greater than 7.0% by mass relative to the total mass of the toner particle 10.

The number of the silica particles 16 that are covered by the shell layer 14 can for example be calculated based on the bulk density of the silica particles 16. The number of silica particles 16 is preferably at least 50,000 particles and no greater than 550,000 particles for each toner particle 10.

The silica particles 16 are preferably hydrophilic. The silica particles 16 being hydrophilic enables good adhesion of the silica particles 16 to the shell layer 14 which contains a melamine resin.

Figure 3A:
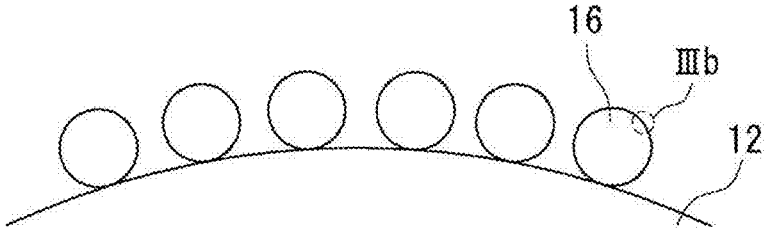
FIG. 3A illustrates silica particles in proximity to the surface of a toner core in a toner according to the embodiment.
Figure 3B:
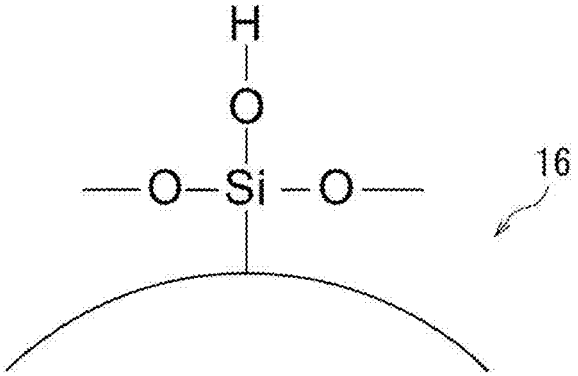
FIG. 3B is an enlarged view of a region (IIIb) in proximity to the surface of a silica particle shown in FIG. 3A.

FIG. 3A illustrates silica particles 16 located on the surface of a toner core 12 in the toner according to the present embodiment. FIG. 3B is an enlarged view of a region (IIIb) in proximity to the surface of one of the silica particles 16 shown in FIG. 3A. The silica particles 16 are hydrophilic and thus silanol groups are present at the surface of the silica particles 16 as shown in FIGS. 3A and 3B.

Figure 4A:
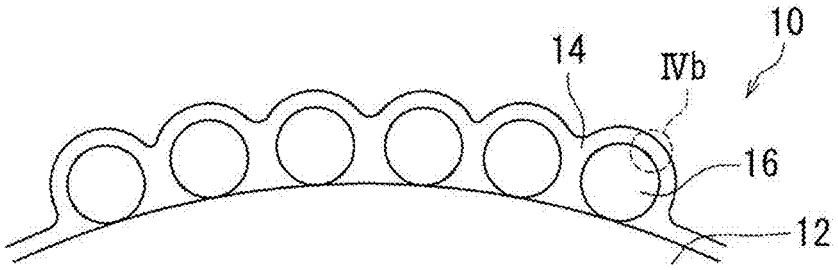
FIG. 4A illustrates silica particles in proximity to the surface of a toner core covered by a shell layer in a toner according to the embodiment.
Figure 4B:
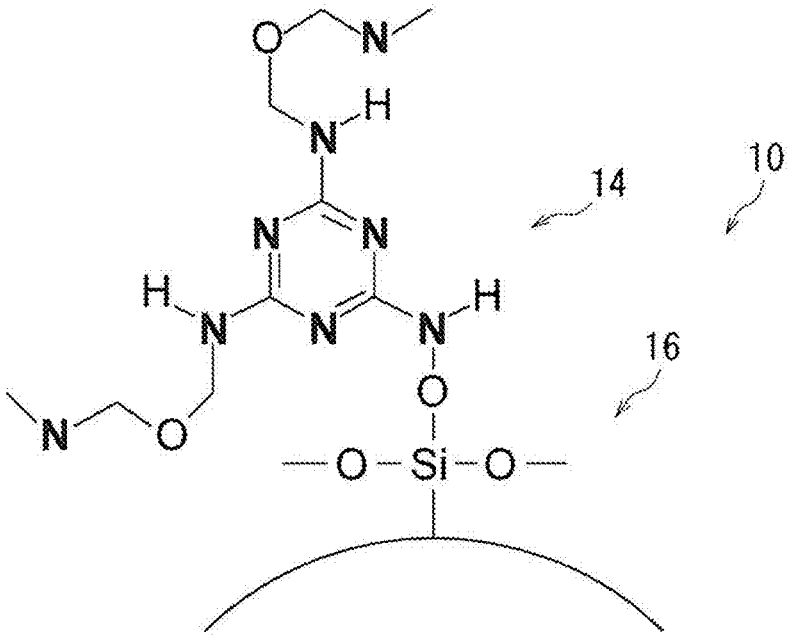
FIG. 4B is an enlarged view of a region (IVb) in proximity to the surface of a silica particle shown in FIG. 4A.

As explained further above, the shell layer 14 preferably contains a melamine resin. FIG. 4A illustrates silica particles 16 located on the surface of a toner core 12 which is covered by a shell layer 14 in the toner according to the present embodiment. FIG. 4B is an enlarged view of a region (IVb) in proximity to the surface of one of the silica particles 16 shown in FIG. 4A.

In a configuration in which the shell layer 14 contains a melamine resin, the silanol groups at the surface of the hydrophilic silica particles 16 react with methylol melamine which is a raw material of the melamine resin. As a consequence, a melamine resin coating (i.e., a shell layer) is also formed over the surface of the hydrophilic silica particles 16. In such a situation, the silica particles 16 adhere to the surface of the toner core 12 and the shell layer 14 in an integrated state with the melamine resin coating. The silica particles 16 being hydrophilic enables good adhesion of the silica particles 16 to the melamine resin-containing shell layer 14. Herein, the term "adhesion" refers to a state in which substituents of the resin contained in the shell layer 14 are chemically bonded to silanol groups of the silica particles 16 and the silica particles 16 are located on the surface of the toner core 12 as an integral part of the shell layer 14. In such a configuration, substantially all of the silica particles 16 may be directly located on the surface of the toner core 12. Alternatively, at least some of the silica particles 16 may be indirectly located on the surface of the toner core 12 (for example, located within the shell layer 14). The silica particles 16 are preferably hydrophilic as described above. However, the silica particles 16 are not limited to being hydrophilic and may alternatively be hydrophobic.

In a situation in which regions are present where the shell layer does not sufficiently cover the toner core, the surface charge density for such regions may differ to the surface charge density for regions where the shell layer sufficiently covers the toner core. As a result, the toner particles may have different surface charge densities to one another, causing aggregation of the toner particles and reduction in fluidity of the toner. Sufficient charging of the toner may not be possible if the fluidity of the toner is reduced.

Therefore, it is preferable that coverage of the toner core 12 by the shell layer 14 is approximately uniform. Coverage of the toner core 12 by the shell layer 14 being approximately uniform ensures electrostatic repulsion between toner particles 10 and as a consequence can inhibit aggregation of the toner particles 10 and reduction in the fluidity and charge of the toner.

In the toner according to the present embodiment, the shell layers 14 sufficiently cover the toner cores 12. A coverage ratio of a toner core 12 by a shell layer 14 can be expressed as a ratio of an intensity INc relative to an intensity INs measured by EELS of a cross-section of the toner particle 10. Herein, the intensity INs indicates intensity of an N—K shell absorption-edge originating from nitrogen atoms contained in the shell layer 14 and the intensity INc indicates intensity of an N—K shell absorption-edge originating from nitrogen atoms contained in the toner core 12. According to the present embodiment, for at least 80% by number of the toner particles 10, along at least 80% of a circumferential length of a cross-section of the toner particle 10 when the cross-section is analyzed by EELS, the shell layer 14 has a thickness of at least 5 nm and satisfies a condition that the ratio (INc/INs) of the intensity INc relative to the intensity INs is at least 0.0 and no greater than 0.2. In the configuration described above, the shell layer 14 sufficiently covers the toner core 12 and, as a result, reduction in toner charge is inhibited.

The coverage ratio of the toner core 12 is obtained based on an EELS intensity map calculated through EELS analysis of an image of the toner particle 10. For example, first a center of mass of the toner particle 10 is identified and a plurality of lines are extended radially from the center of mass such as to define tens of partitioned sections R. Next, mapping is performed for atoms (carbon, oxygen, and nitrogen) in each of the sections R using an EELS detector.

For example, the intensity INc is obtained by measuring the EELS intensity of an N—K shell absorption-band originating from nitrogen atoms contained in the toner core 12 with respect to randomly selected measurement positions in the toner core 12, and calculating an average value of the EELS intensities that are calculated. The intensity INs is obtained by measuring the EELS intensity (intensity INs) of an N—K shell absorption band originating from nitrogen atoms contained in the shell layer 14.

Next, regions are identified in which a condition that a ratio (INc/INs) of the intensity INc relative to the intensity INs is at least 0.0 and no greater than 0.2 is satisfied. When a region where the above condition is satisfied is continuous for at least 5 nm in a direction from the center of mass toward the surface of the toner particle 10, the region is identified as a region where the shell layer 14 is present. A length of the detected shell layer 14 is measured as a proportion of the target section. The coverage ratio of the toner core 12 by the shell layer 14 can be calculated by setting target sections in the same way around the entire circumference of the toner particle 10. A toner particle 10 for which the coverage ratio of the toner core 12 by the shell layer 14 is at least 80% with respect to the entire circumference of the toner core 12 is considered to be a covered toner particle. A judgment is performed as to whether or not at least 80% by number of a plurality of the toner particles 10 are covered toner particles. As a result of at least a specified proportion of the toner particles 10 being covered as described above, reduction in toner charge can be inhibited.

Figure 5A:
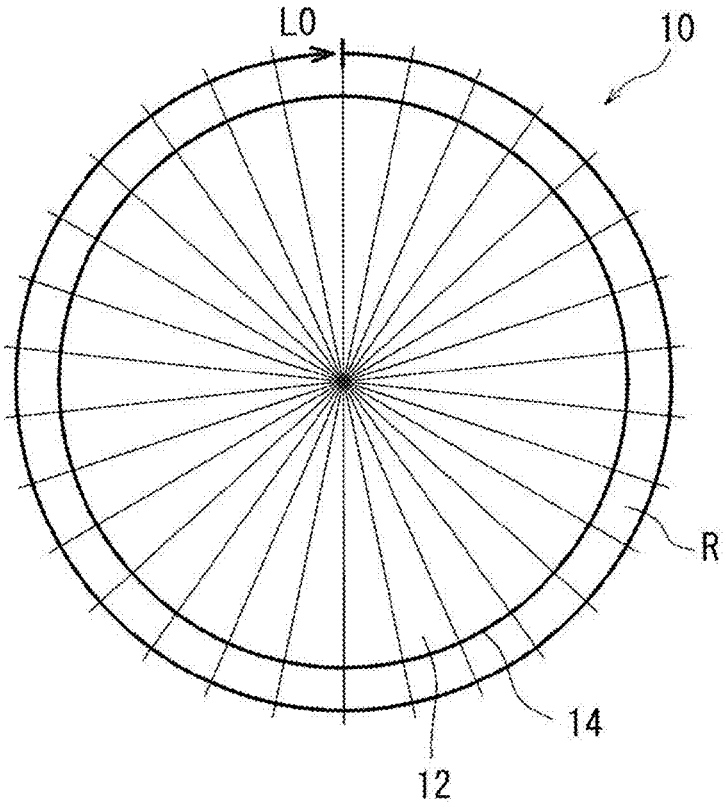
FIGS. 5A and 5B illustrate a method of calculating a coverage ratio of a toner core in a toner according to the embodiment.

The following explains measurement of a coverage ratio Rn with reference to FIGS. 5A, 5B, 6, 7, and 8. FIG. 5A illustrates a toner particle 10 for which the coverage ratio Rn is 100%. Length L0 shown in FIG. 5A indicates the circumferential length of the cross-section of the toner particle 10. When the coverage ratio Rn of the toner core 12 by the shell layer 14 is 100% for the toner particle 10, the shell layer 14 covering the toner core 12 is equal in length to the circumferential length L0 of the cross-section of the toner particle 10.

A proportion (herein referred to as coverage ratio Rn) of the surface of the toner core 12 covered by the shell layer 14 satisfying conditions (1) and (2) shown below is calculated with respect to the entire circumference of the toner core 12. As illustrated in FIG. 5A, lines extending radially from a center point of the toner particle 10 are used to define a plurality of sections R in the toner particle 10 and the coverage ratio Rn is calculated with respect to each of the sections R.

Figure 5B:
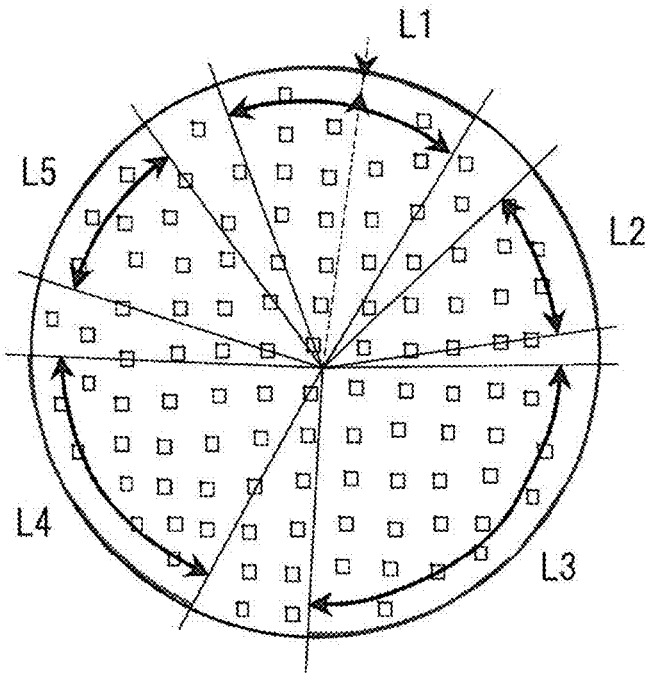

FIG. 5B illustrates a toner particle 10 in which the toner core 12 is only partially covered by the shell layer 14.

The shell layer 14 satisfying conditions (1) and (2) shown below is detected through EELS analysis of a cross-section of the toner particle 10.

(1) The ratio (INc/INs) of an intensity INc of an N—K shell absorption-band originating from nitrogen atoms in the toner core relative to an intensity INs of an N—K shell absorption-band originating from nitrogen atoms in the shell layer is at least 0.0 and no greater than 0.2.

(2) The thickness is at least 5 nm.

In FIG. 5B, lengths L1-L5 indicate regions where conditions (1) and (2) are satisfied. The coverage ratio Rn can be calculated by dividing the sum total of the lengths L1-L5 by the length L0. Thus, the coverage ratio Rn can be calculated based on an expression $Rn=100\times(L1+L2+L3+L4+L5)/L0$.

Each of 100 toner particles 10 (measurement targets) may for example be evaluated as to whether or not the coverage ratio Rn for the toner particle 10 is at least 80%. A number of toner particles 10, among the 100 toner particles 10 (measurement targets), for which the coverage ratio Rn is at least 80% is calculated. Note that a toner particle 10 for which the coverage ratio is at least 80% is equivalent to a toner particle 10 including a shell layer 14 satisfying conditions (1) and (2) along at least 80% of the circumferential length (length L0) of the cross-section of the toner particle 10. The coverage ratio of the toner core 12 by the shell layer 14 can be calculated as explained above.

Figure 6:
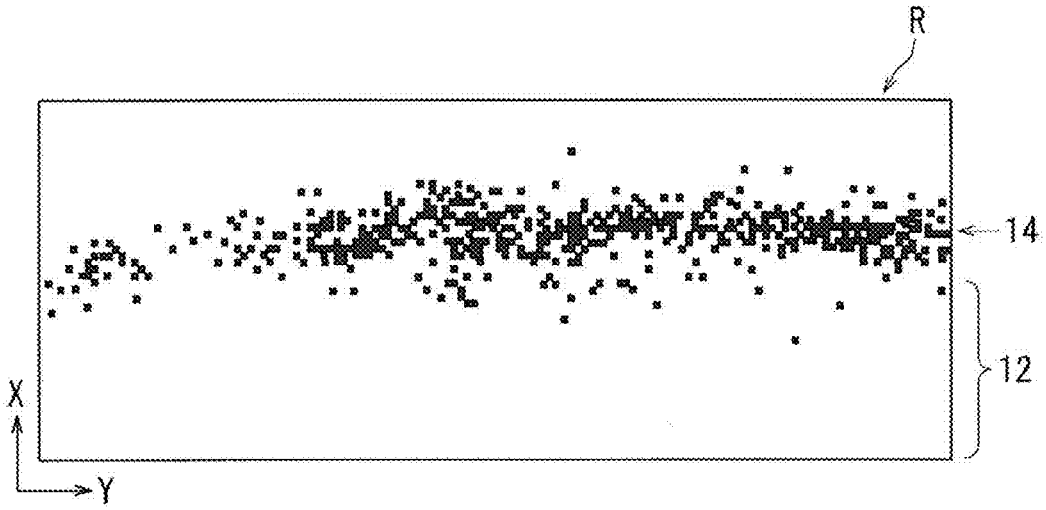
FIG. 6 illustrates an example of a mapping image of EELS intensity in the embodiment.

FIG. 6 is an example of a mapping image generated as an EELS intensity map for a section R. In a mapping image generated using the image analysis software, whiteness of the mapping image is proportional to EELS intensity. A density calibration function of the image analysis software is used to partition the image in terms of image density. More specifically, partitioning is performed for 256 image density values such that a whitest part has a value of 255 and a blackest part has a value of 0. Note that in accordance with provisions relating to patent drawings, regions of high EELS intensity are indicated as black in FIGS. 6-8.

During the aforementioned detection, the EELS intensity of the N—K shell absorption-edge originating from nitrogen atoms in the toner core 12 are measured in the section R. The following explains a method of measuring the EELS intensity of the toner core 12 with reference mainly to FIGS. 6 and 7.

Figure 7:
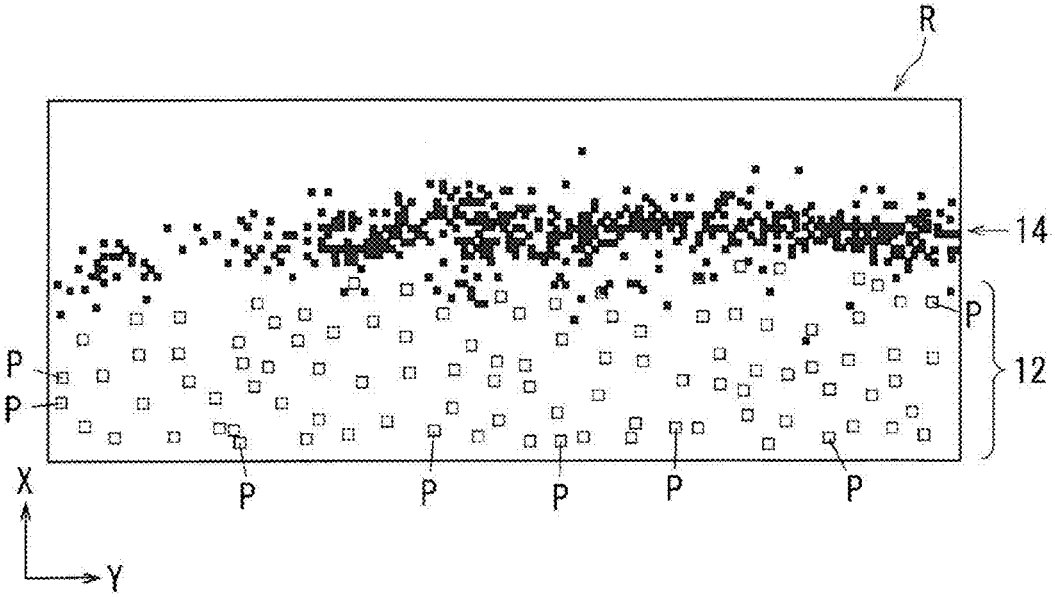
FIG. 7 illustrates a method used in the embodiment to measure EELS intensity of a toner core.

First, 100 positions in a region of the mapping image corresponding to the toner core 12 are randomly selected as measurement positions P as illustrated in FIG. 7. Next, the EELS intensity is measured at each of the 100 selected measurement positions P. Each of the EELS intensities is for example measured according to a 256-value scale and an average value is calculated for the 100 EELS intensities that are calculated. Herein, the EELS intensity of an N—K shell absorption band originating from nitrogen atoms in the toner core 12 is measured for each of the 100 measurement positions P, and the intensity INc (i.e. the value used for evaluation) is taken to be an average value of the 100 EELS intensities that are measured.

In order to satisfy condition (1), the intensity INs must be at least five times as large as the intensity INc (i.e., $INc\times 5\leq INs$). For example, when the intensity INc is 6.8, a given pixel satisfies condition (1) when the intensity INs for the pixel is at least 34 ($=6.8\times5$). When one pixel of the image is equivalent in size to a 5 nm square, so long as at least one pixel indicates that the shell layer 14 satisfying condition (1) is present on the surface of the toner core 12, the thickness of the shell layer 14 is assumed to be at least 5 nm (i.e., condition (2) is satisfied).

Next, the EELS intensity (intensity INs) of an N—K shell absorption-edge originating from nitrogen atoms in the shell layer 14 is measured in the section R in order to detect the shell layer 14 satisfying conditions (1) and (2). More specifically, a binarization function of the image analysis software is used to identify pixels in the image (captured TEM image) as the shell layer 14 satisfying condition (1). Also, as explained above, when one pixel of the image is equivalent in size to a 5 nm square, condition (2) is assumed to be satisfied so long as at least one pixel is identified as the shell layer 14 satisfying condition (1).

Next, the length of the shell layer 14 satisfying conditions (1) and (2) is measured in the section R (more specifically, at the surface of the toner core 12). The following explains a method of measuring the length of the shell layer 14 with reference mainly to FIG. 8.

Figure 8:
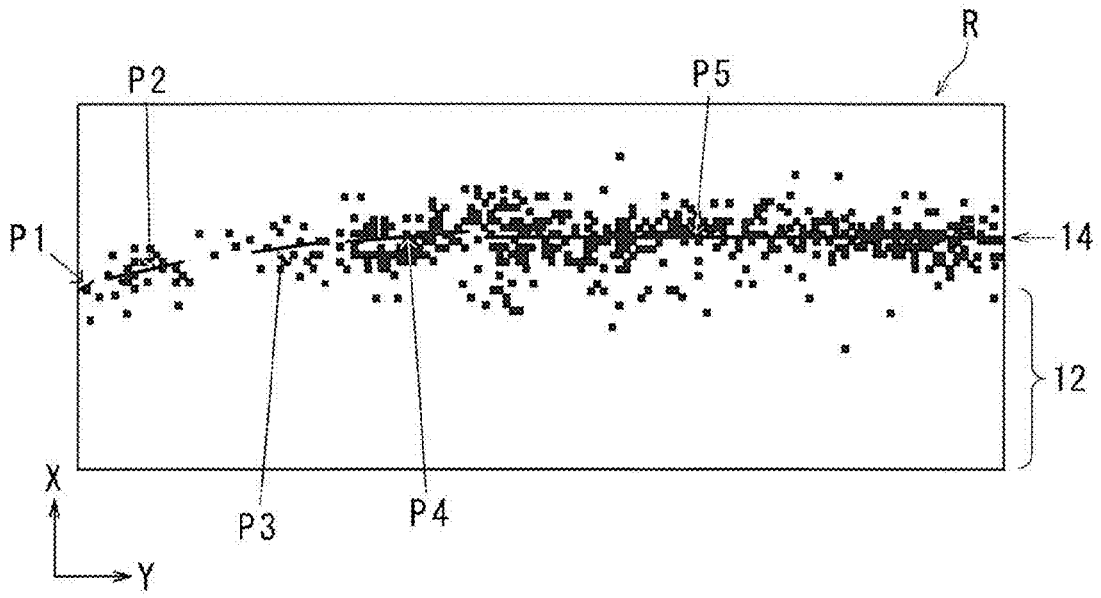
FIG. 8 illustrates a method used in the embodiment to measure length of a shell layer.

The length of the shell layer 14 is measured using a measurement function (manual measurement function and line length measurement function) of the image analysis software. More specifically, as illustrated in FIG. 8, the image analysis software converts the shell layer 14 to the lines P1-P5, and measures the length of each of the lines P1-P5 and the total length of all of the lines P1-P5.

Next, a proportion of the surface of the toner core 12 that is covered by the shell layer 14 satisfying conditions (1) and (2) (i.e., the coverage ratio of the toner core 12) is calculated for the section R. More specifically, the total length (number of pixels) of the shell layer 14 satisfying conditions (1) and (2) is divided by the length of the section R in the Y direction (i.e., the circumferential direction of the toner particle 10). For example, when the length of the section R in the Y direction (circumferential direction of the toner particle 10) is equivalent to 500 pixels and the total length of the lines P1-P5 is equivalent to approximately 400 pixels, the coverage ratio of the toner core 12 is 80.0% ($=400\times100/500$).

Next, a proportion of the surface of the toner core 12 covered by the shell layer 14 satisfying conditions (1) and (2) is calculated with respect to the entire circumference of the toner core 12 (the aforementioned proportion is referred to herein as coverage ratio Rn). Each of 100 toner particles 10 (measurement targets) is evaluated as to whether or not the coverage ratio Rn for the toner particle 10 is at least 80%. A number of toner particles 10, among the 100 toner particles 10 (measurement targets), for which the coverage ratio Rn is at least 80% is calculated. Note that the coverage ratio Rn for a toner particle 10 being at least 80% signifies that in a cross-section of the toner particle 10, a shell layer 14 satisfying conditions (1) and (2) is present along at least 80% of the circumferential length (length L0) of the cross-section. In a configuration such as described above, wherein the toner includes at least a specified amount of toner particles 10 for which a coverage ratio of the toner core 12 by the shell layer 14 is at least 80%, the toner exhibits excellent chargeability.

Note that other particles may optionally be added onto the surface of the toner core 12 in addition to the silica particles 16. For example, particles of a metal oxide (alumina, titanium oxide, magnesium oxide, zinc oxide, strontium titanate, or barium titanate) may be added onto the surface of the toner core 12.

Although not illustrated in the drawings, the toner particle 10 may optionally include an external additive located on the surface of the shell layer 14. The external additive can be included in the toner particles 10 in order to improve the fluidity and the handleability of the toner particles 10. No particular limitation is placed on the method of external additive treatment and any commonly known method may be used. In a specific example, the external additive treatment is performed using a mixer (for example, an FM mixer or a Nauta mixer (registered Japanese trademark)), wherein conditions are set such that the external additive does not become embedded in the shell layer 14.

Examples of the external additive include particles of silica and metal oxides (alumina, titanium oxide, magnesium oxide, zinc oxide, strontium titanate, and barium titanate). In order to improve the fluidity and the handleability of the toner, the external additive preferably has a particle size of at least 0.01 μm and no greater than 1.0 μm.

Note that hereafter in the present specification, the term toner mother particle refers to a toner particle 10 prior to treatment with the external additive (i.e., a toner particle including a toner core 12, a shell layer 14, and silica particles 16). In order to improve the fluidity and the handleability of the toner, the amount of the external additive is preferably at least 1 part by mass and no greater than 10 parts by mass relative to 100 parts by mass of the toner mother particle, and is more preferably at least 2 parts by mass and no greater than 5 parts by mass.

The above explains the toner particles 10 in the toner according to the present embodiment. The toner particles 10 may optionally include a magnetic powder such as ferrite or magnetite, and be used as a so-called one-component developer. The toner particles 10 may alternatively be mixed with a desired carrier and used as a so-called two-component developer.

In a configuration in which the toner particles 10 are mixed with a carrier, the carrier is preferably a magnetic carrier. A specific example of the carrier is a carrier including resin-coated carrier cores. Examples of the carrier cores include: particles of iron, oxidized iron, reduced iron, magnetite, copper, silicon steel, ferrite, nickel, or cobalt; particles of alloys of any of the above substances and a metal such as manganese, zinc, or aluminum; particles of iron-nickel alloys or iron-cobalt alloys; particles of ceramics such as titanium oxide, aluminum oxide, copper oxide, magnesium oxide, lead oxide, zirconium oxide, silicon carbide, magnesium titanate, barium titanate, lithium titanate, lead titanate, lead zirconate, and lithium niobate; and particles of high-dielectric substances such as ammonium dihydrogen phosphate, potassium dihydrogen phosphate, and Rochelle salt. The carrier may for example alternatively be a resin carrier including carrier cores (magnetic particles), such as the examples given above, dispersed in a resin.

Examples of the resin coating the carrier cores include (meth)acrylic-based polymers, styrene-based polymers, styrene-(meth)acrylic-based copolymers, olefin-based polymers (polyethylene, chlorinated polyethylene, and polypropylene), polyvinyl chlorides, polyvinyl acetates, polycarbonates, cellulose resins, polyester resins, unsaturated polyester resins, polyamide resins, polyurethane resins, epoxy resins, silicone resins, fluorine resins (polytetrafluoroethylene, polychlorotrifluoroethylene, and polyvinylidene fluoride), phenolic resins, xylene resins, diallylphthalate resins, polyacetal resins, and amino resins. The resins listed above may be used singly or in a combination of two or more resins.

The carrier preferably has a particle size of at least 20 μm and no greater than 120 μm, and more preferably at least 25 μm and no greater than 80 μm. The particle size of the carrier can be measured by an electron microscope.

In a configuration in which the toner according to the present embodiment is used in a two-component developer, the amount of the toner is preferably at least 3% by mass and no greater than 20% by mass relative to mass of the two-component developer, and more preferably is at least 5% by mass and no greater than 15% by mass.

The toner according to the present embodiment is for example appropriate for use in an image formation technique such as electrophotography. A method for manufacturing the toner according to the present embodiment includes a preparation step of preparing toner cores 12 containing a binder resin, an attachment step of attaching silica particles 16 to the surface of the toner cores 12, and a formation step of forming shell layers 14 that cover the surface of the toner cores 12. The shell layers 14 contain a thermosetting resin and cover the silica particles 16 which are harder than the shell layers 14.

During the preparation step, a component (for example, a colorant, a charge control agent, a releasing agent, or a magnetic powder) other than the binder resin may be well dispersed in the binder resin in accordance with necessity of the aforementioned component. Examples of processes that can be used in order to prepare the toner cores 12 include a melt-kneading and polymerization.

The following explains the melt-kneading process. First, the binder resin is mixed with other optional components in accordance with necessity thereof to yield a mixture. Next, the mixture is melt-kneaded and a melt-knead obtained thereby is subsequently pulverized according to a commonly known pulverization technique. Toner cores 12 of a desired particle size can be obtained by classifying the pulverized product of the pulverization according to a commonly known classification technique.

The following explains the polymerization process. An example of the polymerization process involves obtaining a melt-knead in the same way as described above for the melt-kneading process and subsequently obtaining toner cores by spraying the melt-knead in air using a disc or a multi-fluid nozzle. Another example of the polymerization process involves directly producing toner cores through suspension polymerization. Another example of the polymerization process involves directly producing toner cores through dispersion polymerization using an aqueous-organic solvent in which the initial monomer is soluble but the produced polymer is insoluble. Another example of the polymerization process involves producing toner cores through emulsion polymerization, such as so-called soap-free polymerization, by direct polymerization in the presence of a water-soluble polar polymerization initiator. Another example of the polymerization process involves preparation of primary polar emulsion polymerization particles and subsequent association with oppositely charged polar particles through heteroaggregation.

During the attachment step, the silica particles 16 are caused to attach to the surface of the toner cores 12. Examples of methods that can be used to cause the silica particles 16 to attach to the surface of the toner cores 12 include a method involving mixing the toner cores 12 and the silica particles 16 using a mixer, such as an FM mixer or a Nauta mixer (registered Japanese trademark), wherein conditions are set such that the silica particles 16 do not become completely embedded in the toner cores 12. Note that fluidity of the toner cores 12 and handleability of the toner cores 12 during storage can be improved by causing the silica particles 16 to attach to the toner cores 12 directly after preparation of the toner cores 12.

The formation step includes a supply step of supplying, onto the surface of the toner cores 12, a shell layer formation liquid containing at least one of a monomer and a prepolymer of a thermosetting resin, and a resinification step of resinifying the at least one of the monomer and the prepolymer of the thermosetting resin. Through the above formation step of the shell layers 14, toner particles 10 can be manufactured in which the silica particles 16 are uniformly dispersed throughout the shell layers 14.

In the supply step, the shell layer formation liquid is supplied onto the surface of the toner cores 12. The shell layer formation liquid contains the at least one of the monomer and the prepolymer of the thermosetting resin. Examples of processes that can be used in order to supply the shell layer formation liquid onto the toner cores 12 include a process involving spraying the shell layer formation liquid onto the surface of the toner cores 12 and a process involving soaking the toner cores 12 in the shell layer formation liquid.

The shell layer formation liquid may for example be prepared through stirring, and thereby mixing, of a solvent, the at least one of the monomer and the prepolymer of the thermosetting resin, and other optional additives (for example, a dispersant described below) in accordance with necessity thereof. The solvent may for example be toluene, acetone, methyl ethyl ketone, tetrahydrofuran, or water.

The monomer of the thermosetting resin used in preparation of the shell layer formation liquid is selected as appropriate. The prepolymer of the thermosetting resin used in preparation of the shell layer formation liquid is a polymer precursor for which a certain degree of polymerization of a thermosetting resin monomer has occurred but for which the degree of polymerization is less than that of a polymer. The prepolymer may also be referred to as an initial polymer or an initial polycondensate.

In order to improve dispersibility of the at least one of the monomer and the prepolymer of the thermosetting resin in the solvent, the shell layer formation liquid may optionally contain a commonly known dispersant. The amount of the dispersant contained in the shell layer formation liquid is for example at least 0.1% by mass and no greater than 15% by mass. The amount of the dispersant contained in the shell layer formation liquid being at least 0.1% by mass enables good dispersibility. On the other hand, the amount of the dispersant contained in the shell layer formation liquid being no greater than 15% by mass enables reduction in environmental load caused by the dispersant. The dispersant can be removed from the toner according to the present embodiment through treatment, such as washing, after the toner has been manufactured.

After the supply step, the shell layers 14 are formed over the surface of the toner cores 12 during the resinification step by, for example, forming a thermosetting resin through any appropriate polymerization or condensation process of the at least one of the monomer and the prepolymer of the thermosetting resin contained in the shell layer formation liquid. Note that the resinification is not limited to being complete resinification with a high degree of polymerization, and may instead be partial resinification with an intermediate degree of polymerization.

The reaction temperature (resinification temperature) during the resinification step is preferably maintained as at least 40° C. and no greater than 90° C., and more preferably is maintained as at least 50° C. and no greater than 80° C. The reaction temperature being at least 40° C. can ensure that the shell layers 14 have sufficient hardness. On the other hand, the reaction temperature being no greater than 90° C. can inhibit the shell layers 14 from becoming excessively hard and thus can ensure that the shell layers 14 are readily ruptured through application of heat and pressure during fixing.

The silica particles 16 may alternatively be caused to attach at the same time as the shell layer formation liquid is supplied during formation of the shell layers 14. For example, the silica particles 16 may be contained in the shell layer formation liquid that is supplied during the formation step of the shell layers 14. As explained above, the silica particles 16 are harder than the shell layers 14.

In the process described above in which attachment of the silica particles 16 and supply of the shell layer formation liquid are performed together, no particular limitation is placed on the process for preparing the shell layer formation liquid. For example, the shell layer formation liquid can be prepared by appropriately mixing and stirring any appropriate solvent, at least one of a monomer and a prepolymer of a thermosetting resin, the silica particles 16, and various optional additives (for example, a positively charging agent or a dispersant) in accordance with necessity thereof. The solvent, the at least one of the monomer and the prepolymer of the thermosetting resin, and the dispersant can be the same as the solvent, the at least one of the monomer and the prepolymer of the thermosetting resin, and the dispersant used during preparation of the shell layer formation liquid in the supply step described further above.

Examples of the process for supplying the shell layer formation liquid onto the toner cores 12 include a process involving spraying the shell layer formation liquid onto the surface of the toner cores 12 and a process involving soaking the toner cores 12 in the shell layer formation liquid.

In the resinification step, the shell layers 14 can be formed through resinification of the at least one of the monomer and the prepolymer of the thermosetting resin, thereby yielding the toner particles 10. The resinification can be performed under the same conditions and by the same processes as described further above for the resinification step. As a result of the process described above in which attachment of the silica particles 16 and supply of the shell layer formation liquid are performed at the same time during formation of the shell layers 14, the toner according to the present embodiment can be manufactured through a simplified manufacturing process compared to a process in which the shell layers 14 are formed after the silica particles 16 have been caused to attach.

The above describes a manufacturing method according to the present embodiment. In the manufacturing method according to the present embodiment, once the formation step for the shell layers 14 is complete, the toner may be subjected to one or more steps selected from a washing step, a drying step, and an external addition step. In the washing step, the toner particles 10 are for example washed with water after the shell layers 14 have been formed.

In the drying step, the toner particles 10 are for example dried by a dryer (for example, a spray dryer, a fluidized bed dryer, a vacuum freeze dryer, or a reduced pressure dryer) after the toner particles 10 have been washed. Use of a spray dryer during drying is preferable in terms of inhibiting aggregation of the toner particles 10. In a process in which a spray dryer is used, a liquid dispersion of an external additive (for example, silica particles) can also be sprayed during the drying, enabling an external addition step described below to be performed at the same time as the drying step.

The following describes the external addition step. In the external addition step, an external additive is caused to attach to the surface of the shell layers 14. A preferable example of a process for causing attachment of the external additive involves mixing the external additive and the toner particles 10 using a mixer (for example, an FM mixer or a Nauta mixer (registered Japanese trademark)), wherein external addition conditions are set such that the external additive does not become embedded in the surface of the shell layers 14.

The following explains fixing of the toner according to the present embodiment. A method of fixing the toner includes a toner supply step of supplying the toner particles 10 onto the surface of a recording medium, and a load application step of applying a load of at least 5 $N/cm^2$ and no greater than 10 $N/cm^2$ on the recording medium having the toner particles 10 supplied onto the surface thereof.

A toner image is developed as described below prior to supplying the toner particles 10 onto the surface of the recording medium in the toner supply step. In an image forming apparatus, development of a toner image is for example performed by charging the surface of an image bearing member through a technique such as corona discharge. Next, an electrostatic latent image is formed on the charged surface of the image bearing member by irradiating the surface of the image bearing member with a beam of light. Toner is subsequently applied onto the surface of the image bearing member on which the electrostatic latent image is formed. The toner is attracted to an irradiated part of the surface of the image bearing member, thereby developing a toner image of the electrostatic latent image. Next, toner is supplied onto the recording medium by for example using a transfer roller to transfer the toner image onto the recording medium from the surface of the image bearing member.

In the load application step, a load of at least 5 $N/cm^2$ and no greater than 10 $N/cm^2$ is applied to the recording medium having the toner particles 10 supplied onto the surface thereof. The applied load causes fixing of the toner particles 10 to the recording medium.

Note that in each of the toner particles 10 may alternatively include a plurality of shell layers 14 covering the toner core 12. In such a configuration in which the toner particles 10 each include a plurality of shell layers 14 that are layered on one another, an outermost of the shell layers 14 is preferably cationic.

Preferably the toner cores 12 are anionic and a material of the shell layers 14 is cationic. As a consequence of the toner cores 12 being anionic, the cationic material of the shell layers 14 is attracted toward the surface of the toner cores 12 during formation of the shell layers 14. More specifically, the material of the shell layers 14, which is positively charged in an aqueous medium, is electrically attracted toward the toner cores 12, which are negatively charged in the aqueous medium, and the shell layers 14 are for example formed over the surface of the toner cores 12 through in-situ polymerization. Through the above process, the shell layers 14 can readily be formed in a uniform manner on the surface of toner cores 12 without needing to use a dispersant in order to cause a high degree of dispersion of the toner cores 12 in the aqueous medium.

The binder resin may compose the majority (for example, at least 85% by mass) of the toner component of the toner cores 12. When the toner cores 12 have such a composition, the polarity of the binder resin has a significant influence on the overall polarity of the toner cores 12. For example, when the binder resin has an ester group, a hydroxyl group, an ether group, an acid group, or a methyl group, the toner cores 12 have a high tendency to be anionic. In contrast, when the binder resin for example includes an amino group, an amine, or an amide group, the toner cores 12 have a high tendency to be cationic.

EXAMPLES

The following explains Examples of the present disclosure. Toners in Examples 1-7 and toners in Comparative Example 1-3 were evaluated (refer to Tables 1 and 2 shown below). The following explains, in order, the preparation method, the evaluation method, and the evaluation results for the toners in Examples 1-7 and the toners in Comparative Examples 1-3. The present disclosure is of course not limited to the aforementioned Examples.

Example 1

[Toner Preparation Method of Example 1]

<Preparation of Toner Cores A>

The following explains a process for preparing toner cores A in the method of preparing the toner in Example 1.

In Example 1, 750 g of a low viscosity polyester resin, 100 g of a medium viscosity polyester resin, 150 g of a high viscosity polyester resin, 55 g of a releasing agent, and 40 g of a colorant were mixed for five minutes at a rotation speed of 2,400 rpm using a mixer (FM mixer produced by Nippon Coke & Engineering Co. Ltd.). The low viscosity polyester resin had a Tg of 38° C. and a Tm of 65° C. The medium viscosity polyester resin had a Tg of 53° C. and a Tm of 84° C. The high viscosity polyester resin had a Tg of 71° C. and a Tm of 120° C. KET Blue 111 (Phthalocyanine Blue) produced by DIC Corporation was used as the colorant. Carnauba Wax No. 1 produced by S. Kato & Co. was used as the releasing agent.

Next, the resulting mixture was melt-kneaded using a twin screw extruder (PCM-30 produced by Ikegai Corp.) under conditions of a material addition rate of 5 kg/hour, a shaft rotation speed of 160 rpm, and a temperature range from at least 100° C. to no greater than 130° C. A melt-knead obtained through the above was subsequently cooled.

Next, the melt-knead was roughly pulverized using a pulverizer (Rotoplex (registered Japanese trademark) 16/8 produced by Hosokawa Micron Corporation). The roughly pulverized product was finely pulverized using a jet mill (Model-I Super Sonic Jet Mill produced by Nippon Pneumatic Mfg.). Next, the toner cores A were obtained through classification of the finely pulverized product using a classifier (Elbow-Jet EJ-LABO produced by Nittetsu Mining Co., Ltd.).

<Attachment of Silica Particles (Attachment Step)>

An FM mixer model FM-10 was used to mix 1 kg of the toner cores A and 10 g (i.e., 1.0% by mass relative to the mass of the toner cores A) of hydrophilic silica particles SP1 (AEROSIL (registered Japanese trademark) 130 produced by Nippon Aerosil Co., Ltd.; specific surface area 130 $m^2/g$) for five minutes at 3,200 rpm, thereby causing the silica particles to attach to the surface of the toner cores A.

<Supply Step>

A three-necked flask having a capacity of 1 L was set up in a 30° C. water bath. In the flask, ion exchanged water (300 mL) was adjusted to pH 4 using hydrochloric acid. Next, 1.8 g of water-soluble methylol melamine (Nikaresin (registered Japanese trademark) S-260 produced by Nippon Carbide Industries Co.) was added to the ion exchanged water and dissolved therein in order that shell layers having a thickness of 6 nm could be formed. Next, 300 g of the mixture of the toner cores A and the silica particles was added to the aqueous solution in the flask and the contents of the flask were sufficiently stirred.

A further 300 mL of ion exchanged water was added to the contents of the flask while continuing to stir the contents and the internal temperature of the flask was increased to 70° C. at a heating rate of 1° C./minute. Once the flask had been heated to 70° C., the contents of the flask were stirred for a further two hours at 70° C. and 120 rpm using a propeller stirring impeller. Next, the contents of the flask were neutralized by adding sodium hydroxide until the contents of the flask had been adjusted to pH 7. After neutralization, the contents of the flask were cooled to room temperature to yield a toner-containing liquid. Next, the toner-containing liquid was filtered and washed to yield a wet cake of toner that was subsequently dried. The toner in Example 1 was obtained in the manner described above.

<Coverage Ratio Measurement>

The following explains how the coverage ratio of the toner cores 12 by the shell layers 14 was measured for the toner in Example 1. First, the toner was dispersed in a cold setting epoxy resin and left to harden for two days at an ambient temperature of 40° C. to yield a hardened material. The hardened material was dyed in osmium tetroxide and subsequently a flake sample of 200 nm in thickness was cut therefrom using a microtome (EM UC6 produced by Leica Microsystems) equipped with a diamond knife. A cross-sectional image of the sample (i.e., a cross-sectional image of a toner particle 10) was captured using a field emission type transmission electron microscope (JEM-2100F produced by JEOL Ltd.) with an accelerating voltage of 200 kV.

Figure 9A:
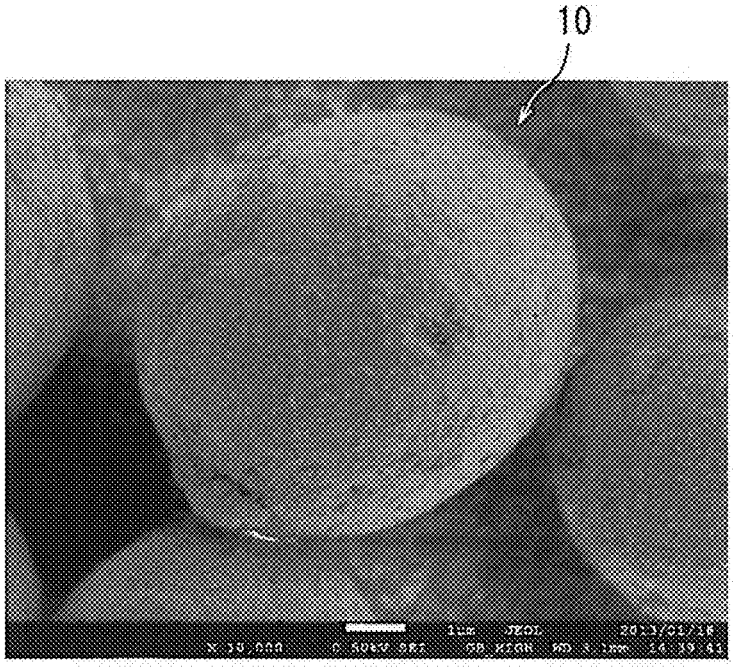
FIG. 9A is a transmission electron microscopy (TEM) image of a toner particle in a toner according to the embodiment.
Figure 9B:
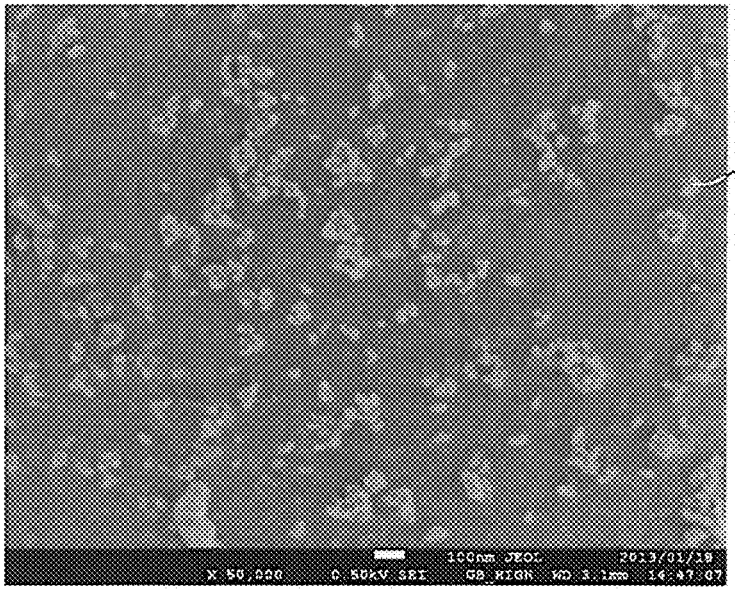
FIG. 9B is an enlarged view of a section of FIG. 9A.

The following explains the toner in Example 1 with reference to FIGS. 9A and 9B. FIG. 9A is a TEM image of a toner particle 10 included in the toner in Example 1. FIG. 9B is an enlarged view of a section of FIG. 9A. A random selection of 100 toner particles 10 depicted in captured TEM images were determined to be measurement targets.

Next, each captured TEM image was analyzed using an electron energy loss spectrometer (GIF TRIDEM (registered Japanese trademark) produced by Gatan, Inc.), having an energy resolution of 1.0 eV and a beam diameter of 1.0 nm, and image analysis software (WinROOF 5.5.0 provided by Mitani Corporation). More specifically, an EELS intensity map was generated for atoms (carbon, oxygen, and nitrogen K shell absorption-edges) contained in the shell layer. One pixel of the image (captured TEM image) was equivalent in size to a 5 nm square.

Generation of the EELS intensity map (mapping) was performed as explained further above with reference to FIGS. 5A, 5B, 6, 7, and 8. As explained above with reference to FIG. 5A, a center of mass G of the toner particle 10 was first identified using the image analysis software (WinROOF). Next, lines were extended radially from the center of mass G, thereby partitioning the surface of the toner particle 10 into 30 sections R. Mapping was subsequently performed for nitrogen with respect to each of the partitions (sections R) using the electron energy loss spectrometer.

As a result, a mapping image such as illustrated schematically in FIG. 6 was obtained through EELS intensity mapping with respect to the section R. In the mapping image generated using the image analysis software (WinROOF), the whiteness of the mapping image was proportional to the EELS intensity. Therefore, a density calibration function of the image analysis software (WinROOF) was used to perform partitioning of the mapping image in terms of image density. More specifically, partitioning was performed for 256 image density values such that a whitest section had a value of 255 and a blackest section had a value of 0.

The cross-section of the toner particle 10 was analyzed by EELS in order to detect a shell layer satisfying conditions (1) and (2) shown below.

(1) The ratio (INc/INs) of an intensity INc of an N—K shell absorption-edge originating from nitrogen atoms in the toner core 12 relative to an intensity INs of an N—K shell absorption-edge originating from nitrogen atoms in the shell layer 14 is at least 0.0 and no greater than 0.2.

(2) The thickness is at least 5 nm.

During the aforementioned detection, the EELS intensity of the N—K shell absorption-edge originating from nitrogen atoms in the toner core 12 was measured in the section R. First, 100 positions in a region of the mapping image corresponding to the toner core 12 were randomly selected as measurement positions P as illustrated schematically in FIG. 7. Next, the EELS intensity was measured at each of the 100 selected measurement positions P. The EELS intensity was measured on a 256-value scale. Next, an average value was calculated for the 100 EELS intensities measured as described above. More specifically, the EELS intensity of an N—K shell absorption-edge originating from nitrogen atoms in the toner core 12 was measured for each of the 100 measurement positions P. The average value for the 100 EELS intensities that were measured was determined to be the intensity INc (i.e., the value used for evaluation).

In order to satisfy condition (1), the intensity INs must be at least five times as large as the intensity INc (i.e., $INc \times 5 \leq INs$). For example, when the intensity INc is 6.8, a given pixel satisfies condition (1) if the intensity INs for the pixel is at least 34 (=6.8×5). Note that one pixel of the image was equivalent in size to a 5 nm square. Therefore, so long as at least one pixel indicated that a shell layer satisfying condition (1) was present on the surface of the toner core 12, the shell layer was assumed to have a thickness of at least 5 nm (i.e., condition (2) was assumed to be satisfied).

Next, the EELS intensity (intensity INs) of an N—K shell absorption-edge originating from nitrogen atoms in the shell layer 14 was measured throughout the section R in order to detect the shell layer 14 satisfying conditions (1) and (2). More specifically, a binarization function of the image analysis software (WinROOF) was used to identify pixels in the image (captured TEM image) as the shell layer 14 satisfying condition (1). As explained above, condition (2) was assumed to be satisfied so long as at least one pixel was identified as the shell layer 14 satisfying condition (1).

Next, the length was measured of the shell layer 14 satisfying conditions (1) and (2) in the section R (more specifically, at the surface of the toner core 12). The following explains a method for measuring the length of the shell layer 14 with reference mainly to FIG. 8.

The length of the shell layer 14 was measured using a measurement function (manual measurement function and line length measurement function) of the image analysis software (WinROOF). More specifically, as illustrated in FIG. 8, the image analysis software (WinROOF) converted the shell layer 14 into lines P1-P5, and measured the length of each of the lines P1-P5 and the total length of all of the lines P1-P5.

Next, a proportion of the surface of the toner core 12 that was covered by the shell layer 14 satisfying conditions (1) and (2) (i.e., the coverage ratio of the toner core 12) was calculated for the section R. More specifically, the length (number of pixels) of the shell layer 14 satisfying conditions (1) and (2) was divided by 500 pixels. Note that 500 pixels corresponds to the length of the section R in the Y direction (circumferential direction of the toner particle 10).

Next, a coverage ratio Rn was calculated for satisfaction of conditions (1) and (2) with respect to the entire circumference of the toner core 12. As illustrated in FIG. 5A, a coverage ratio of the toner core 12 was calculated with respect to each of the 30 partitioned sections R in the same way as described above. An average value of 30 coverage ratios calculated as described above was determined to be the coverage ratio Rn (i.e., the value used for evaluation). Note that the coverage ratio Rn calculated as an average value for the 30 sections R is equivalent to the coverage ratio Rn calculated as explained below by dividing a sum total of lengths L1-L5 by length L0 (cross-section circumferential length).

As illustrated schematically in FIG. 5B, the coverage ratio Rn was calculated by dividing a sum total of the lengths L1-L5 by the length L0 (circumferential length of the cross-section). Thus, the coverage ratio Rn was calculated based on an expression $Rn=100\times(L1+L2+L3+L4+L5)/L0$. Each of 100 toner particles 10 (measurement targets) was evaluated as to whether or not the coverage ratio Rn for the toner particle 10 was at least 80%. A number of toner particles 10, among the 100 toner particles 10 (measurement targets), for which the coverage ratio Rn was at least 80% was calculated. Note that the coverage ratio Rn for a toner particle 10 being at least 80% signifies that a shell layer 14 satisfying conditions (1) and (2) is present along at least 80% of the circumferential length (length L0) of the cross-section of the toner particle 10. Preferably at least 80 of the toner particles are particles (herein referred to as conforming particles) that upon EELS analysis, include a region where average INc/INs is at least 0.0 and no greater than 0.2, which has a thickness of at least 5 nm and is continuous for at least 100 nm in the surface direction. In other words, preferably at least 80% by number of the toner particles are conforming particles. Upon EELS analysis of the toner in Example 1, 97 particles were determined to be conforming particles (i.e., 97% by number of the toner particles were conforming particles). When the toner particles of the toner in Example 1 were observed using a scanning electron microscope (SEM), the silica particles were disposed uniformly on the surface of the toner cores.

[Toner Evaluation Method of Example 1]

The following explains evaluation of the toner in Example 1.

(Initial Charge)

A two-component developer was prepared by adding 1 kg of a developer carrier (carrier for TASKalfa5550) and 10% by mass (100 g) of the toner in Example 1, relative to the mass of the carrier, into a 3 L plastic bottle and mixing the contents of the bottle for 30 minutes at 30 rpm. The charge of the two-component developer directly after preparation (i.e., the initial charge) was measured at a temperature of 20° C. and a relative humidity of 60%. The charge of the two-component developer directly after preparation is preferably at least 30 μC/g and less than 60 μC/g. The charge was measured using a Q/m meter (Model 210HS-1 produced by TREK, Inc.).

(Initial Toner Replenishment)

A replenishment device was made by modifying a toner replenishment mechanism of a color multifunction peripheral (TASKalfa 5550 produced by KYOCERA Document Solutions Inc.), and an amount of toner per unit time supplied from a toner container to a developing device was measured. The amount of supplied toner (toner replenishment) when the color multifunction peripheral prints successive solid images is preferably at least 30 g/minute.

(Testing Evaluation (Charge, Image Density, Toner Scattering, Replenishment Fogging))

The two-component developer prepared as described above was added into a color multifunction peripheral (TASKalfa 5550 produced by KYOCERA Document Solutions Inc.), and 100,000 successive sheets of plain paper were printed on with a coverage of 5% at a temperature of 20° C. and a relative humidity of 60%. After the printing, charge of the toner, image density (ID), and an amount of toner that had dripped within the developing device during printing (i.e., an amount of toner scattering) were measured. The charge of the toner after the printing is preferably at least 8 μC/g and less than 25 μC/g. The image density (ID) is preferably at least 1.2. The toner scattering (amount of dripped toner) is preferably no greater than 200 mg.

The charge was measured using a Q/m meter (Model 210HS-1 produced by TREK, Inc.). The image density (ID) was measured using a spectrophotometer (SpectroEye produced by Sakata Inx Eng.). The amount of toner scattering (amount of dripped toner) was measured by collecting toner that had dripped within the developing device. The mass of the collected toner was then measured.

If the surface of the carrier of the developer becomes contaminated with silica during a printing durability test, fogging has a high tendency to occur upon rapid replenishment of the toner. Therefore, a degree of fogging (replenishment fogging) was calculated for when enforced replenishment of toner in the developing device was performed at a rate of 30 g/minute for one minute after a printing durability test of 100,000 sheets. Fogging measured through the enforced toner replenishment test is preferably no greater than 0.01.

(Carrier Contamination)

Silica particles that become dissociated during the printing durability test may attach to the surface of the carrier, adversely affecting chargeability of the developer. Therefore, the amount of silica attached to the surface of the carrier after the printing durability test was evaluated using an X-ray fluorescence spectrometer (ZSX produced by Rigaku Corporation; end window model; Rh target; 4.0 kw). In terms of evaluation method, once a 100,000 sheet durability test had been performed using the multifunction peripheral, the carrier after the test was obtained by separating the toner from the developer using a 635-mesh (opening size 20 μm) sieve and a vacuum cleaning device. The obtained carrier was held in place in an X-ray fluorescence holder using adhesive tape, and X-ray fluorescence intensity of Si—Kα radiation (herein referred to as Si X-ray intensity or Si X-ray fluorescence intensity) was measured under the following conditions: 50 kV, 30 mA, PET analyzing crystal, PC detector. Fogging has a high tendency to occur when the X-ray fluorescence intensity of Si—Kα radiation exceeds approximately 80 kcps. Therefore, the X-ray fluorescence intensity of Si—Kα radiation is preferably no greater than 80 kcps.

[Evaluation Results]

Replenishment of the toner in Example 1 was evaluated by measuring the rate of toner supply using the replenishment device. The measured result for toner supply was 54 g/minute as compared to the preferable value of at least 30 g/minute, thus indicating that the toner had good fluidity.

A developer was formed using the toner in Example 1 and initial charge of the developer was measured. The measured result for the initial charge was 52 μC/g as compared to the preferable value of at least 30 μC/g and less than 60 μC/g. The above indicates that the toner in Example 1 had good charge despite the fact that the toner cores 12 did not contain a charge control agent or a charge control resin.

Next, the charge of the developer including the toner in Example 1 was measured after loading the developer into the multifunction peripheral and performing a printing durability test of 100,000 sheets. The measured result for the charge was 21 μC/g as compared to the preferable value of at least 8 μC/g and less than 25 μC/g. Image density was also measured after the printing durability test. The measured result for the image density was 1.3 as compared to the preferable value of at least 1.2.

The amount of toner scattering was also measured after the printing durability test. The measured result for toner scattering was 76 mg as compared to the preferable value of no greater than 200 mg.

Fogging was evaluated by performing an enforced toner replenishment test after the printing durability test. The measured result for fogging was 0.002 as compared to the preferable value of no greater than 0.01, and almost no fogging occurred.

Si X-ray fluorescence intensity of the carrier was also measured after the printing durability test. The Si X-ray fluorescence intensity is an indicator of deterioration of the developer. The measured result for the Si X-ray fluorescence intensity was 62 kcps as compared to the preferable value of no greater than 80 kcps. As described above, the toner in Example 1 produced good results for all of the evaluation criteria.

Example 2

[Toner Preparation Method of Example 2]

In the preparation method of the toner in Example 2, the additive amount of water-soluble methylol melamine (Nikaresin (registered Japanese trademark) S-260) was changed to 1.5 g in order that the shell layers 14 had a thickness (film thickness) of 5 nm. However, in all other aspects the toner in Example 2 was prepared according to the same method as the toner in Example 1.

Upon EELS analysis of the toner in Example 2, 82 toner particles were determined to be toner particles (conforming particles) including a region where average INc/INs is at least 0.0 and no greater than 0.2, which has a thickness of at least 5 nm and is continuous for at least 100 nm in the surface direction (i.e., 82% by number of the toner particles were conforming particles). In comparison to the above result, the preferable value is at least 80 toner particles (i.e., preferably at least 80% by number of toner particles are conforming particles). When the toner in Example 2 was observed using an SEM, the silica particles were disposed uniformly on the surface of the toner cores.

[Evaluation Results]

Replenishment of the toner in Example 2 was evaluated by measuring the rate of toner supply using the replenishment device. The measured result for toner supply was 48 g/minute as compared to the preferable value of at least 30 g/minute. A developer was formed using the toner in Example 2 and initial charge of the developer was measured. The measured result for the initial charge was 34 μC/g as compared to the preferable value of at least 30 μC/g and less than 60 μC/g.

Next, charge of the developer including the toner in Example 2 was measured after loading the developer into the multifunction peripheral and performing a printing durability test of 100,000 sheets. The measured result for the charge was 10 μC/g as compared to the preferable value of at least 8 μC/g and less than 25 μC/g. Image density was also measured after the printing durability test. The measured result for the image density was 1.4 as compared to the preferable value of at least 1.2.

The amount of toner scattering was also measured after the printing durability test. The measured result for toner scattering was 180 mg as compared to the preferable value of no greater than 200 mg.

Fogging was evaluated by performing an enforced toner replenishment test after the printing durability test. The measured result for fogging was 0.005 as compared to the preferable value of no greater than 0.01.

Si X-ray fluorescence intensity of the carrier was also measured after the printing durability test. The measured result for the Si X-ray fluorescence intensity was 77 kcps as compared to the preferable value of no greater than 80 kcps. As described above, the toner in Example 2 produced good results for all of the evaluation criteria.

Example 3

[Toner Preparation Method of Example 3]

In the preparation method of the toner in Example 3, silica particles SP2 (AEROSIL (registered Japanese trademark) 300 produced by Nippon Aerosil Co., Ltd.; specific surface area 300 $m^2/g$) were used instead of the hydrophilic silica particles SP1 (AEROSIL (registered Japanese trademark) 130). However, in all other aspects the toner in Example 3 was prepared according to the same method as the toner in Example 1.

Upon EELS analysis of the toner in Example 3, 92 toner particles were determined to be toner particles (conforming particles) including a region where average INc/INs is at least 0.0 and no greater than 0.2, which has a thickness of at least 5 nm and is continuous for at least 100 nm in the surface direction (i.e., 92% by number of the toner particles were conforming particles). In comparison to the above result, the preferable value is at least 80 toner particles (i.e., preferably at least 80% by number of toner particles are conforming particles). When the toner in Example 3 was observed using an SEM, the silica particles were disposed uniformly on the surface of the toner cores.

[Evaluation Results]

Replenishment of the toner in Example 3 was evaluated by measuring the rate of toner supply using the replenishment device. The measured result for toner supply was 32 g/minute as compared to the preferable value of at least 30 g/minute. A developer was formed using the toner in Example 3 and initial charge of the developer was measured. The measured result for the initial charge was 45 μC/g as compared to the preferable value of at least 30 μC/g and less than 60 μC/g.

Next, charge of the developer including the toner in Example 3 was measured after loading the developer into the multifunction peripheral and performing a printing durability test of 100,000 sheets. The measured result for the charge was 9 μC/g as compared to the preferable value of at least 8 μC/g and less than 25 μC/g. Image density was also measured after the printing durability test. The measured result for the image density was 1.4 as compared to the preferable value of at least 1.2.

The amount of toner scattering was also measured after the printing durability test. The measured result for toner scattering was 132 mg as compared to the preferable value of no greater than 200 mg.

Fogging was evaluated by performing an enforced toner replenishment test after the printing durability test. The measured result for fogging was 0.004 as compared to the preferable value of no greater than 0.01.

Si X-ray fluorescence intensity of the carrier was also measured after the printing durability test. The measured result for the Si X-ray fluorescence intensity was 72 kcps as compared to the preferable value of no greater than 80 kcps. As described above, the toner in Example 3 produced good results for all of the evaluation criteria.

Example 4

[Toner Preparation Method of Example 4]

In the preparation method of the toner in Example 4, silica particles SP3 (NIPSIL (registered Japanese trademark) E-75 produced by Tosoh Silica Corporation; specific surface area 45 $m^2/g$) were used instead of the hydrophilic silica particles SP1 (AEROSIL (registered Japanese trademark) 130). However, in all other aspects the toner in Example 4 was prepared according to the same method as the toner in Example 1.

Upon EELS analysis of the toner in Example 4, 90 toner particles were determined to be toner particles (conforming particles) including a region where average INc/INs is at least 0.0 and no greater than 0.2, which has a thickness of at least 5 nm and is continuous for at least 100 nm in the surface direction (i.e., 90% by number of the toner particles were conforming particles). In comparison to the above result, the preferable value for the above is at least 80 toner particles (i.e., preferably at least 80% by number of toner particles are conforming particles). When the toner in Example 4 was observed using an SEM, the silica particles were disposed uniformly on the surface of the toner cores.

[Evaluation Results]

Replenishment of the toner in Example 4 was evaluated by measuring the rate of toner supply using the replenishment device. The measured result for toner supply was 36 g/minute as compared to the preferable value of at least 30 g/minute. A developer was formed using the toner in Example 4 and initial charge of the developer was measured. The measured result for the initial charge was 50 μC/g as compared to the preferable value of at least 30 μC/g and less than 60 μC/g.

Next, charge of the developer including the toner in Example 4 was measured after loading the developer into the multifunction peripheral and performing a printing durability test of 100,000 sheets. The measured result for the charge was 24 μC/g as compared to the preferable value of at least 8 μC/g and less than 25 μC/g. Image density was also measured after the printing durability test. The measured result for the image density was 1.2 as compared to the preferable value of at least 1.2.

The amount of toner scattering was also measured after the printing durability test. The measured result for toner scattering was 190 mg as compared to the preferable value of no greater than 200 mg.

Fogging was evaluated by performing an enforced toner replenishment test after the printing durability test. The measured result for fogging was 0.005 as compared to the preferable value of no greater than 0.01.

Si X-ray fluorescence intensity of the carrier was also measured after the printing durability test. The measured result for the Si X-ray fluorescence intensity was 75 kcps as compared to the preferable value of no greater than 80 kcps. As described above, the toner in Example 4 produced good results for all of the evaluation criteria.

Example 5

[Toner Preparation Method of Example 5]

In the preparation method of the toner in Example 5, the additive amount of the hydrophilic silica particles SP1 was 5 g (0.5% by mass relative to mass of the toner cores A) instead of 10 g. However, in all other aspects the toner in Example 5 was prepared according to the same method as the toner in Example 1.

Upon EELS analysis of the toner in Example 5, 98 toner particles were determined to be toner particles (conforming particles) including a region where average INc/INs is at least 0.0 and no greater than 0.2, which has a thickness of at least 5 nm and is continuous for at least 100 nm in the surface direction (i.e., 98% by number of the toner particles were conforming particles). In comparison to the above result, the preferable value is at least 80 toner particles (i.e., preferably at least 80% by number of toner particles are conforming particles). When the toner in Example 5 was observed using an SEM, the silica particles were disposed uniformly on the surface of the toner cores.

[Evaluation Results]

Replenishment of the toner in Example 5 was evaluated by measuring the rate of toner supply using the replenishment device. The measured result for toner supply was 35 g/minute as compared to the preferable value of at least 30 g/minute. A developer was formed using the toner in Example 5 and initial charge of the developer was measured. The measured result for the initial charge was 58 μC/g as compared to the preferable value of at least 30 μC/g and less than 60 μC/g.

Next, charge of the developer including the toner in Example 5 was measured after loading the developer into the multifunction peripheral and performing a printing durability test of 100,000 sheets. The measured result for the charge was 24 μC/g as compared to the preferable value of at least 8 μC/g and less than 25 μC/g. Image density was also measured after the printing durability test. The measured result for the image density was 1.2 as compared to the preferable value of at least 1.2.

The amount of toner scattering was also measured after the printing durability test. The measured result for the toner scattering was 66 mg as compared to the preferable value of no greater than 200 mg.

Fogging was evaluated by performing an enforced toner replenishment test after the printing durability test. The measured result for fogging was 0.002 as compared to the preferable value of no greater than 0.01.

Si X-ray fluorescence intensity of the carrier was also measured after the printing durability test. The measured result for the Si X-ray fluorescence intensity was 37 kcps as compared to the preferable value of no greater than 80 kcps. As described above, the toner in Example 5 produced good results for all of the evaluation criteria.

Example 6

[Toner Preparation Method of Example 6]

In the preparation method of the toner in Example 6, the additive amount of the hydrophilic silica particles SP1 was 50 g (5.0% by mass relative to mass of the toner cores A) instead of 10 g. However, in all other aspects the toner in Example 6 was prepared according to the same method as the toner in Example 1.

Upon EELS analysis of the toner in Example 6, 82 toner particles were determined to be toner particles (conforming particles) including a region where average INc/INs is at least 0.0 and no greater than 0.2, which has a thickness of at least 5 nm and is continuous for at least 100 nm in the surface direction (i.e., 82% by number of the toner particles were conforming particles). In comparison to the above result, the preferable value is at least 80 toner particles (i.e., preferably at least 80% by number of toner particles are conforming particles). When the toner in Example 6 was observed using an SEM, the silica particles were disposed uniformly on the surface of the toner cores.

[Evaluation Results]

Replenishment of the toner in Example 6 was evaluated by measuring the rate of toner supply using the replenishment device. The measured result for toner supply was 60 g/minute as compared to the preferable value of at least 30 g/minute. A developer was formed using the toner in Example 6 and initial charge of the developer was measured. The measured result for the initial charge was 33 μC/g as compared to the preferable value of at least 30 μC/g and less than 60 μC/g.

Next, charge of the developer including the toner in Example 6 was measured after loading the developer into the multifunction peripheral and performing a printing durability test of 100,000 sheets. The measured result for the charge was 18 μC/g as compared to the preferable value of at least 8 μC/g and less than 25 μC/g. Image density was also measured after the printing durability test. The measured result for the image density was 1.5 as compared to the preferable value of at least 1.2.

The amount of toner scattering was also measured after the printing durability test. The measured result for toner scattering was 182 mg as compared to the preferable value of no greater than 200 mg.

Fogging was evaluated by performing an enforced toner replenishment test after the printing durability test. The measured result for fogging was 0.005 as compared to the preferable value of no greater than 0.01.

Si X-ray fluorescence intensity of the carrier was also measured after the printing durability test. The measured result for the Si X-ray fluorescence intensity was 78 kcps as compared to the preferable value of no greater than 80 kcps. As described above, the toner in Example 6 produced good results for all of the evaluation criteria.

Example 7

[Toner Preparation Method of Example 7]

In the preparation method of the toner in Example 7, silica particles SP4 (AEROSIL (registered Japanese trademark) 100 produced by Nippon Aerosil Co., Ltd.; specific surface area 100 $m^2/g$) were used instead of the hydrophilic silica particles SP1 (AEROSIL (registered Japanese trademark) 130). However, in all other aspects the toner in Example 7 was prepared according to the same method as the toner in Example 1.

Upon EELS analysis of the toner in Example 7, 86 toner particles were determined to be toner particles (conforming particles) including a region where average INc/INs is at least 0.0 and no greater than 0.2, which has a thickness of at least 5 nm and is continuous for at least 100 nm in the surface direction (i.e., 86% by number of the toner particles were conforming particles). In comparison to the above result, the preferable value is at least 80 toner particles (i.e., preferably at least 80% by number of toner particles are conforming particles). When the toner in Example 7 was observed using an SEM, the silica particles were disposed uniformly on the surface of the toner cores.

[Evaluation Results]

Replenishment of the toner in Example 7 was evaluated by measuring the rate of toner supply using the replenishment device. The measured result for toner supply was 32 g/minute as compared to the preferable value of at least 30 g/minute. A developer was formed using the toner in Example 7 and initial charge of the developer was measured. The measured result for the initial charge was 58 μC/g as compared to the preferable value of at least 30 μC/g and less than 60 μC/g.

Next, charge of the developer including the toner in Example 7 was measured after loading the developer into a multifunction peripheral and performing a printing durability test of 100,000 sheets. The measured result for the charge was 24 μC/g as compared to the preferable value of at least 8 μC/g and less than 25 μC/g. Image density was also measured after the printing durability test. The measured result for the image density was 1.3 as compared to the preferable value of at least 1.2.

The amount of toner scattering was also measured after the printing durability test. The measured result for toner scattering was 123 mg as compared to the preferable value of no greater than 200 mg.

Fogging was evaluated by performing an enforced toner replenishment test after the printing durability test. The measured result for fogging was 0.007 as compared to the preferable value of no greater than 0.01.

Si X-ray fluorescence intensity of the carrier was also measured after the printing durability test. The measured result for the Si X-ray fluorescence intensity was 75 kcps as compared to the preferable value of no greater than 80 kcps. As described above, the toner in Example 7 produced good results for all of the evaluation criteria.

Comparative Example 1

[Toner Preparation Method of Comparative Example 1]

In the preparation method of the toner in Comparative Example 1, addition of the hydrophilic silica particles SP1 was not performed (in other words, the silica particles SP1 were not caused to attach to the surface of the toner cores A).

However, in all other aspects the toner in Comparative Example 1 was prepared according to the same method as the toner in Example 1. Note that in contrast to the toner in Example 1 which exhibited sufficient fluidity without performing external additive treatment, in order to improve fluidity of the toner in Comparative Example 1, external additive treatment (external addition step) was performed in Comparative Example 1 after performing the supply step and drying the wet cake in the same way as in Example 1. More specifically, 10 g of silica particles SP5 (RP130 produced by Nippon Aerosil Co., Ltd.; specific surface area 130 $m^2/g$; 1.0% by mass relative to the mass of the toner mother particles) and 1 kg of the toner mother particles were mixed for five minutes at 2,400 rpm using an FM mixer in the same way as in Example 1. Note that the silica particles SP5 are silica particles obtained through positive charge hydrophobic treatment of the hydrophilic silica particles SP1 (AEROSIL (registered Japanese trademark) 130 produced by Nippon Aerosil Co., Ltd.; specific surface area 130 $m^2/g$) used in Example 1. Through the above, the toner in Comparative Example 1 was obtained.

Upon EELS analysis of the toner in Comparative Example 1, 98 toner particles were determined to be toner particles (conforming particles) including a region where average INc/INs is at least 0.0 and no greater than 0.2, which has a thickness of at least 5 nm and is continuous for at least 100 nm in the surface direction (i.e., 98% by number of the toner particles were conforming particles). In comparison to the above result, the preferable value is at least 80 toner particles (i.e., preferably at least 80% by number of toner particles are conforming particles).

[Evaluation Results]

Replenishment of the toner in Comparative Example 1 was evaluated by measuring the rate of toner supply using the replenishment device. The measured result for toner supply was 48 g/minute as compared to the preferable value of at least 30 g/minute, indicating that the toner had good fluidity. A developer was formed using the toner in Comparative Example 1 and initial charge of the developer was measured. The measured result for the initial charge was 79 μC/g, and thus was high compared to the preferable value of at least 30 μC/g and less than 60 μC/g.

Next, the amount of toner scattering of the developer including the toner in Comparative Example 1 was measured after loading the developer into the multifunction peripheral and performing a printing durability test of 100,000 sheets. The measured result for toner scattering was 80 mg as compared to the preferable value of no greater than 200 mg, indicating no problems in terms of toner scattering.

The charge of the developer was also measured after the printing durability test. The measured result for the charge was 86 μC/g, and thus was high compared to the preferable value of at least 8 μC/g and less than 25 μC/g. Image density was also measured after the printing durability test. The measured result for the image density was 0.8, and thus was low compared to the preferable value of at least 1.2.

Fogging was evaluated by performing an enforced toner replenishment test after the printing durability test. The measured result for fogging was 0.012 as compared to the preferable value of no greater than 0.01, and fogging occurred.

Si X-ray fluorescence intensity of the carrier was also measured after the printing durability test. The measured result for the Si X-ray fluorescence intensity was 92 kcps, and thus was fairly high compared to the preferable value of no greater than 80 kcps. In consideration of the above results for the toner in Comparative Example 1, it is thought that when the enforced toner replenishment test was performed after the printing durability test, fogging occurred due the surface of the carrier being contaminated by silica from the external additive treatment that had become dissociated from the surface of the toner particles.

Comparative Example 2

[Toner Preparation Method of Comparative Example 2]

The following explains preparation of the toner in Comparative Example 2. First, 450 g of a low viscosity polyester resin (Tg 38° C., Tm 65° C.), 100 g of a medium viscosity polyester resin (Tg 53° C., Tm 84° C.), 450 g of a high viscosity polyester resin (Tg 71° C., Tm 120° C.), 55 g of a releasing agent (Carnauba Wax No. 1 produced by S. Kato & Co.), 40 g of a colorant (KET BLUE 111 produced by DIC Corporation; Phthalocyanine Blue), and 40 g of a charge control agent (CCA; P-51 produced by Orient Chemical Industries Co., Ltd; 4% by mass relative to total mass of the low, medium, and high viscosity polyester resins) were mixed under the same conditions as in Example 1. After the above, melt-kneading, rough pulverization, fine pulverization, and classification were performed under the same conditions as in Example 1 with the exception of the melt-kneading temperature which was changed to at least 120° C. and no greater than 150° C. Note that the attachment of silica particles (attachment step) and the supply step performed in Example 1 were not performed after the above steps in Comparative Example 2. After classification of the toner cores, external additive treatment (external addition step) was performed according to the same method as in Comparative Example 1. Through the above, the toner in Comparative Example 2 was obtained. The toner in Comparative Example 2 had a positive charge even without capsulation.

Upon EELS analysis of the toner in Comparative Example 2, none of the toner particles were determined to be toner particles including a region where average INc/INs is at least 0.0 and no greater than 0.2, which has a thickness of at least 5 nm and is continuous for at least 100 nm in the surface direction.

[Evaluation Results]

Replenishment of the toner in Comparative Example 2 was evaluated by measuring the rate of toner supply using the replenishment device. The measured result for toner supply was 32 g/minute as compared to the preferable value of at least 30 g/minute. A developer was formed using the toner in Comparative Example 2 and initial charge of the developer was measured. The measured result for the initial charge was 32 μC/g as compared to the preferable value of at least 30 μC/g and less than 60 μC/g.

Next, image density of the developer including the toner in Comparative Example 2 was measured after loading the developer into a multifunction peripheral and performing a printing durability test of 100,000 sheets. The measured result for the image density was 1.5 as compared to the preferable value of at least 1.2.

The charge of the developer was also measured after the printing durability test. The evaluation result for the charge was 5 μC/g, and thus was low compared to the preferable value of at least 8 μC/g and less than 25 μC/g. The amount of toner scattering was also measured after the printing durability test. The measured result for toner scattering was 321 mg, and thus was high compared to the preferable value of no greater than 200 mg.

Fogging was evaluated by performing an enforced toner replenishment test after the printing durability test. The measured result for fogging was 0.008, and thus was relatively high compared to the preferable value of no greater than 0.01.

Si X-ray fluorescence intensity of the carrier was also measured after the printing durability test. The measured result for the Si X-ray fluorescence intensity was 274 kcps, and thus was high compared to the preferable value of no greater than 80 kcps. In consideration of the above results for the toner in Comparative Example 2, it is thought that when the enforced toner replenishment test was performed after the printing durability test, fogging was relatively high due to the surface of the carrier being contaminated by silica from the external additive treatment that had become dissociated from the surface of the toner cores.

Comparative Example 3

[Toner Preparation Method of Comparative Example 3]

In the preparation method of the toner in Comparative Example 3, the additive amount of the aqueous methylol melamine (Nikaresin (registered Japanese trademark) S-260 produced by Nippon Carbide Industries Co., Inc.) was changed to 1.2 g in order that the shell layers had a thickness of 4 nm. However, in all other aspects the toner in Comparative Example 3 was prepared according to the same method as the toner in Example 1.

Upon EELS analysis of the toner in Comparative Example 3, 70 toner particles were determined to be toner particles (conforming particles) including a region where average INc/INs is at least 0.0 and no greater than 0.2, which has a thickness of at least 5 nm and is continuous for at least 100 nm in the surface direction (i.e., 70% by number of the toner particles were conforming particles). Thus, the number of toner particles that were determined to be conforming particles was low compared to the preferable value of at least 80 toner particles (i.e., preferably at least 80% by number of toner particles are conforming particles). When the toner in Comparative Example 3 was observed by SEM, the silica particles were disposed somewhat irregularly on the surface of the toner cores.

[Evaluation Results]

Replenishment of the toner in Comparative Example 3 was evaluated by measuring the rate of toner supply using the replenishment device. The measured result for toner supply was 40 g/minute as compared to the preferable value of at least 30 g/minute. A developer was formed using the toner in Comparative Example 3 and initial charge of the developer was measured. The measured result for the initial charge was 28 μC/g, and thus was fairly low compared to the preferable value of at least 30 μC/g and less than 60 μC/g.

Next, image density of the developer including the toner in Comparative Example 3 was measured after loading the developer into the multifunction peripheral and performing a printing durability test of 100,000 sheets. The measured result for the image density was 1.5 as compared to the preferable value of at least 1.2.

The charge of the developer was also measured after the printing durability test. The measured result for the charge was 5 μC/g, and thus was low compared to the preferable value of at least 8 μC/g and less than 25 μC/g. The amount of toner scattering was also measured after the printing durability test. The measured result for toner scattering was 250 mg, and thus was high compared to the preferable value of no greater than 200 mg.

Fogging was evaluated by performing an enforced toner replenishment test after the printing durability test. The measured result for fogging was 0.006 as compared to the preferable value of no greater than 0.01.

Si X-ray fluorescence intensity of the carrier was also measured after the printing durability test. The measured result for the Si X-ray fluorescence intensity was 90 kcps as compared to the preferable value of no greater than 80 kcps.

Tables 1 and 2 summarize evaluation results for Examples 1-7 and Comparative Examples 1-3.

TABLE 1

| | Silica | | | | | Proportion |
|---|---|---|---|---|---|---|
| | Layer thickness (nm) | Type | Attachment step additive amount [% by mass] | External addition step additive amount [% by mass] | CCA Amount [% by mass] | of conforming toner particles [% by number] |
| Example 1 | 6 | SP1 | 1.0 | — | 0 | 97 |
| Example 2 | 5 | SP1 | 1.0 | — | 0 | 82 |
| Example 3 | 6 | SP2 | 1.0 | — | 0 | 92 |
| Example 4 | 6 | SP3 | 1.0 | — | 0 | 90 |
| Example 5 | 6 | SP1 | 0.5 | — | 0 | 98 |
| Example 6 | 6 | SP1 | 5.0 | — | 0 | 82 |
| Example 7 | 6 | SP4 | 1.0 | — | 0 | 86 |
| Comparative Example 1 | 6 | SP5 | — | 1.0 | 0 | 98 |
| Comparative Example 2 | 0 | SP5 | — | 1.0 | 4 | 0 |
| Comparative Example 3 | 4 | SP1 | 1.0 | — | 0 | 70 |

TABLE 2

| | Initial | | After printing 100,000 sheets | | | | |
|---|---|---|---|---|---|---|---|
| | Charge [μC/g] | Replenishment [g/minute] | Charge [μC/g] | ID | Toner scattering [mg] | Si X-ray fluorescence intensity [kcps] | Replenishment fogging |
| Example 1 | 52 | 54 | 21 | 1.3 | 76 | 62 | 0.002 |
| Example 2 | 34 | 48 | 10 | 1.4 | 180 | 77 | 0.005 |
| Example 3 | 45 | 32 | 9 | 1.4 | 132 | 72 | 0.004 |
| Example 4 | 50 | 36 | 24 | 1.2 | 190 | 75 | 0.005 |
| Example 5 | 58 | 35 | 24 | 1.2 | 66 | 37 | 0.002 |
| Example 6 | 33 | 60 | 18 | 1.5 | 182 | 78 | 0.005 |
| Example 7 | 58 | 32 | 24 | 1.3 | 123 | 75 | 0.007 |
| Comparative Example 1 | 79 | 48 | 86 | 0.8 | 80 | 92 | 0.012 |
| Comparative Example 2 | 32 | 32 | 5 | 1.5 | 321 | 274 | 0.008 |
| Comparative Example 3 | 28 | 40 | 5 | 1.5 | 250 | 90 | 0.006 |

As shown in Tables 1 and 2, in the toner in each of Examples 1-7, the toner particles 10 each include a toner core 12, silica particles 16 located on the surface of the toner core 12, and a shell layer 14 disposed over the surface of the toner core 12. For at least 80% by number of the toner particles 10, along at least 80% of a circumferential length of a cross-section of the toner particle 10 when the cross-section is analyzed by EELS, the shell layer has a thickness of at least 5 nm and satisfies a condition that a ratio (INc/INs) of an intensity INc of an N—K shell absorption band originating from nitrogen atoms in the toner core 12 relative to an intensity INs of an N—K shell absorption band originating from nitrogen atoms in the shell layer 14 is at least 0.0 and no greater than 0.2. In other words, at least 80% by number of the toner particles 10 have a coverage ratio Rn of at least 80%.

In contrast to the above, in the toner in each of Comparative Examples 1 and 2, the toner particles do not include silica particles located on the surface of the toner cores. Furthermore, in the toner in Comparative Example 3, fewer than 80% by number of the toner particles 10 have a coverage ratio Rn of at least 80%.

In terms of charge of the two-component developer directly after preparation, the charge was at least 30 μC/g and less than 60 μC/g for the toner in each of Examples 1-7. In contrast, the charge was not less than 60 μC/g for the toner in Comparative Example 1 and was less than 30 μC/g for the toner in Comparative Example 3.

In terms of charge of the two-component developer after printing 100,000 sheets, the charge was at least 8 μC/g and less than 25 μC/g for the toner in each of Examples 1-7. In contrast, the charge was at least 25 μC/g for the toner in Comparative Example 1 and was less than 8 μC/g for the toner in each of Comparative Examples 2 and 3.

In terms of image density (ID) after printing 100,000 sheets, the image density was at least 1.2 for the toner in each of Examples 1-7. In contrast, the image density was less than 1.2 for the toner in Comparative Example 1.

In terms of toner scattering (amount of dripped toner) after printing 100,000 sheets, the toner scattering was no greater than 200 mg for the toner in each of Examples 1-7. In contrast, the toner scattering was greater than 200 mg for the toner in each of Comparative Examples 2 and 3.

In terms of replenishment fogging after printing 100,000 sheets, the replenishment fogging was no greater than 0.01 for the toner in each of Examples 1-7. In contrast, the replenishment fogging was greater than 0.01 for the toner in Comparative Example 1.

In terms of Si X-ray fluorescence intensity after printing 100,000 sheets, the intensity was no greater than 80 kcps for the toner in each of Examples 1-7. In contrast, the intensity was greater than 80 kcps for the toner in each of Comparative Examples 1-3.

As explained above, the toners in Examples 1-7 had excellent charge. In addition to having excellent charge, the toners in Examples 1-7 had excellent properties in terms of image density, toner scattering (amount of dripped toner), replenishment fogging, and Si X-ray fluorescence intensity.

What is claimed is:

1. A toner comprising toner particles each including:

a toner core;

silica particles located on a surface of the toner core; and a shell layer disposed over the surface of the toner core on which the silica particles are located, wherein the silica particles having an average particle size of at least 10 nm and no greater than 100 nm, the shell layer having an average thickness of at least 5 nm and no greater than 80 nm, the average thickness of the shell layer being smaller than the average particle size of the silica particles, for at least 80% by number of the toner particles, along at least 80% of a circumferential length of a cross-section of the toner particle when the cross-section is analyzed by EELS, the shell layer has a thickness of at least 5 nm and satisfies a condition that a ratio of an intensity INc relative to an intensity INs is at least 0.0 and no greater than 0.2, and the intensity INs indicates intensity of an N—K shell absorption-edge originating from nitrogen atoms in the shell layer and the intensity INc indicates intensity of an N—K shell absorption-edge originating from nitrogen atoms in the toner core.

2. A toner according to claim 1, wherein the intensity INc is an average value of 100 EELS intensities measured with respect to 100 randomly selected positions in the toner core.

3. A toner according to claim 1, wherein the shell layer contains a thermosetting resin.

4. A toner according to claim 1, wherein the shell layer contains a melamine resin.

5. A toner according to claim 1, wherein the silica particles adhere to the surface of the toner core.

6. A toner according to claim 1, wherein the toner core contains a polyester resin.

7. A toner according to claim 1, wherein the silica particles have an average particle size of at least 10 nm and no greater than 50 nm.

8. A toner according to claim 1, wherein the silica particles have a specific surface area of at least 45 $m^2/g$ and no greater than 350 $m^2/g$.

9. A toner according to claim 1, wherein an amount of the silica particles is at least 0.3% by mass and no greater than 7.0% by mass relative to a total mass of the toner particle.

10. A toner according to claim 1, wherein the silica particles are hydrophilic.

* * * * *